US008992632B2

(12) United States Patent
Holzhauer et al.

(10) Patent No.: US 8,992,632 B2
(45) **Date of Patent: *Mar. 31, 2015**

(54) LIQUID CLEANING COMPOSITIONS

(75) Inventors: Frederick W. Holzhauer, Novato, CA (US); Kaj Johnson, Livermore, CA (US)

(73) Assignee: Method Products, PBC, San Francisco, CA (US)

( * ) Notice: Subject to any disclaimer, the term of this patent is extended or adjusted under 35 U.S.C. 154(b) by 19 days.

This patent is subject to a terminal disclaimer.

(21) Appl. No.: 12/859,209

(22) Filed: Aug. 18, 2010

(65) Prior Publication Data

US 2010/0299846 A1 Dec. 2, 2010

Related U.S. Application Data

(63) Continuation of application No. 12/493,081, filed on Jun. 26, 2009.

(60) Provisional application No. 61/143,937, filed on Jan. 12, 2009, provisional application No. 61/105,627, filed on Oct. 15, 2008.

(51) Int. Cl.

| | |
|---|---|
| ***C11D 3/60*** | (2006.01) |
| ***B08B 3/08*** | (2006.01) |
| ***C11D 17/08*** | (2006.01) |
| ***C11D 1/83*** | (2006.01) |
| ***D06F 35/00*** | (2006.01) |
| ***D06M 23/10*** | (2006.01) |
| ***C11D 17/00*** | (2006.01) |
| ***C11D 3/386*** | (2006.01) |
| ***C11D 3/43*** | (2006.01) |

(52) U.S. Cl.

CPC ..... *C11D 1/83* (2013.01); *D06F 35/006* (2013.01); *D06M 23/10* (2013.01); *C11D 17/0021* (2013.01); *C11D 3/386* (2013.01); *C11D 3/43* (2013.01)

USPC ..... 8/137; 510/417

(58) Field of Classification Search

USPC ..... 510/421; 8/137

See application file for complete search history.

(56) References Cited

U.S. PATENT DOCUMENTS

| | | | | |
|---|---|---|---|---|
| 3,829,506 | A | 8/1974 | Schmolka et al. | |
| 4,079,078 | A | 3/1978 | Collins | |
| 4,105,592 | A | 8/1978 | Collins | |
| 4,285,841 | A | 8/1981 | Barrat et al. | |
| 4,507,219 | A * | 3/1985 | Hughes | 510/341 |
| 4,588,516 | A | 5/1986 | Schwartz | |
| 4,743,394 | A * | 5/1988 | Kaufmann et al. | 510/296 |
| 4,973,416 | A | 11/1990 | Kennedy | |
| 5,035,826 | A | 7/1991 | Durbut et al. | |
| 5,783,546 | A | 7/1998 | Bettiol et al. | |
| 5,786,318 | A | 7/1998 | Blokzijl et al. | |
| 5,856,287 | A | 1/1999 | Motyka et al. | |
| 6,008,178 | A | 12/1999 | Baillely et al. | |
| 6,037,319 | A | 3/2000 | Dickler et al. | |
| 6,136,776 | A | 10/2000 | Dickler et al. | |
| 6,479,448 | B2 | 11/2002 | Cropper et al. | |
| 6,528,070 | B1 * | 3/2003 | Bratescu et al. | 424/401 |
| 6,670,316 | B2 | 12/2003 | Sidoti et al. | |
| 6,820,626 | B1 | 11/2004 | Jonke et al. | |
| 6,894,016 | B2 | 5/2005 | Ishikawa et al. | |
| 6,936,578 | B2 | 8/2005 | Cordellina et al. | |
| 6,995,127 | B1 | 2/2006 | Smith et al. | |
| 7,179,780 | B2 | 2/2007 | Forth et al. | |
| 7,189,686 | B2 | 3/2007 | Burt et al. | |
| 7,273,841 | B2 | 9/2007 | Colurciello et al. | |
| 2002/0187909 | A1 * | 12/2002 | Gupta et al. | 510/295 |
| 2003/0013630 | A1 | 1/2003 | Ishikawa et al. | |
| 2004/0167054 | A1 | 8/2004 | Tcheou | |
| 2006/0172912 | A1 | 8/2006 | Burt et al. | |

FOREIGN PATENT DOCUMENTS

| | | | |
|---|---|---|---|
| GB | 2 373 254 | A | 9/2002 |
| WO | WO 00/04119 | A1 | 1/2000 |
| WO | WO 00/18868 | A1 | 4/2000 |
| WO | WO 0018868 | A1 * | 4/2000 |

OTHER PUBLICATIONS

Flickinger, Michael C. Drew, Stephen W. (1999). Encyclopedia of Bioprocess Technology—Fermentation, Biocatalysis, and Bioseparation, vols. 1-5 . John Wiley & Sons. Online version available at: http://app.knovel.com/hotlink/toc/id:kpEBTFBBV1/encyclopedia-bioprocess (file attached as two separate PDFs, one for the title page and one for the text).*

International Search Report and Written Opinion from PCT Application No. PCT/US09/05569 mailed on Dec. 2, 2009.

"New Melapower 6X and Melabrite 6X: Because There's More Than Just Laundry on the Line," EcoSense™, p. 8-10.

Examiner's Answer and Advisory Action from U.S. Appl. No. 12/493,081 dated Apr. 14, 2011.

(Continued)

*Primary Examiner* — Harold Pyon
*Assistant Examiner* — Katie L Hammer
(74) *Attorney, Agent, or Firm* — Zilka-Kotab, PC

(57) ABSTRACT

A cleaning composition according to one embodiment includes a surfactant system comprising nonionic surfactant in combination with an anionic surfactant; water present in an amount from 0 to about 40 wt % based on a total weight of the cleaning composition; a solvent system comprising a polyalcohol, the solvent system being present in an amount effective to solubilize the surfactant system in the water; and an enzyme present in an amount of less than about 15 wt %; wherein the cleaning composition is in a form of a continuous phase, wherein the cleaning composition is characterized as exhibiting about a constant cleaning efficacy as measured using test procedure ASTM D4265 when the cleaning composition is added to 69 liters of exterior water in amounts ranging from about 9 to about 22 grams of cleaning composition. Methods for pretreating and cleaning laundry and non-textile surfaces are also presented.

46 Claims, 22 Drawing Sheets

(56) References Cited

OTHER PUBLICATIONS

International Search Report and Written Opinion from PCT application No. PCT/US2011/028900 dated Jun. 1, 2011.
International Preliminary Report on Examination from PCT application No. PCT/US2009/005569 dated Apr. 28, 2011.
Non-Final Office Action Summary from U.S. Appl. No. 12/93,081 dated Oct. 12, 2010.
Final Office Action Sumrriary from U.S. Appl. No. 12/493,081 dated Jan. 4, 2011.
International Preliminary Report on Patentability from PCT Application No. PCT/US2011/028900 dated Sep. 27, 2012.
Chinese Office Action from application No. 200980141111.1 dated Dec. 18, 2012.
Extended European Search Report from application No. 09820873.9 dated Nov. 9, 2012.
Non-Final Office Action from U.S. Appl. No. 13/050,491 dated May 3, 2014.
Non-Final Office Action from U.S. Appl. No. 12/493,081 dated Feb. 27, 2014.
Notice of Registration from Chinese application No. 200980141111.1 dated Apr. 23, 2014.
Restriction/Election Requirement from U.S. Appl. No. 13/050,491 dated Oct. 1, 2014.
Office Action from Australian application No. 2009303873 dated Jul. 17, 2014.

* cited by examiner

LIQUID CLEANING COMPOSITIONS

RELATED APPLICATIONS

This application is a continuation of U.S. patent application Ser. No. 12/493,081 filed Jun. 26, 2009, and claims priority to U.S. Provisional Patent Application No. 61/143,937, filed Jan. 12, 2009; and to U.S. Provisional Patent Application No. 61/105,627, filed Oct. 15, 2008, respectively, and which are all, herein incorporated by reference.

BACKGROUND

The present invention relates to liquid cleaning compositions.

Liquid cleaning compositions are used more widely than non-liquid cleaning, compositions, such as granules, pastes, gels, and mulls. Consumers favor liquid cleaning compositions for convenience and appearance. Liquid cleaning compositions are easily measurable, readily dissolvable in water, and are capable of being applied to heavily stained areas in concentrated solution for pre-treatment. Furthermore, a clear or opaque liquid with a particular color is aesthetically appealing to consumers. In addition, liquid cleaning compositions can incorporate many performance enhancing ingredients that cannot withstand dry operation while eliminating certain environmentally hazardous ingredients, such as phosphate builder.

However, conventional liquid cleaning compositions contain undesirably large percentages of water, which increase the cost of packaging and shipping due to more energy use and handling efforts. Furthermore, the conventional liquid cleaning compositions have mediocre or poor performance in cold or warm water or without agitation. Heat and agitation during cleaning not only consumes more energy, but also increases wear and damage to substrates, especially fabric.

Thus, there is still a strong need for a liquid cleaning composition that is effective even though packaged in a concentrated form. There is also a strong and unmet need for such a liquid composition that has an improved performance in cold or warm water. Moreover, there is also a need for a liquid composition that is more environmentally friendly.

There is also a strong and unmet need for a liquid cleaning composition that can be easily dispensed by a small, handheld pump dispenser. Previous attempts at providing a pumpable detergent generally used a "condiment type" dispenser on a very large reservoir (due to the large amount of detergent required per washload), making the container overly-tall, heavy (when full), and generally difficult to handle. Moreover, prior art formulations were designed to have a high viscosity for various reasons including: providing the appearance of having a higher concentration of actives, less product runs out if the bottle tips over, and providing the appearance that the product will adhere better to the surface to be cleaned. However, the higher viscosity would make the product more difficult to pump. This alone may be the reason why handheld pumpable laundry detergent containers are not presently on the market.

SUMMARY

A cleaning composition according to one embodiment includes a surfactant system comprising a nonionic surfactant in combination with an anionic surfactant; water present in an amount from 0 to about 40 wt % based on a total weight of the cleaning, composition; a solvent system comprising a polyalcohol, the solvent system being present in an amount effective to solubilize the surfactant system in the water; and an enzyme present in an amount of less than about 15 wt %; wherein the cleaning composition is in a form of a continuous phase, wherein the cleaning composition is characterized as exhibiting about a constant cleaning efficacy as measured using test procedure ASTM D4265 when the cleaning composition is added to 69 liters of exterior water in amounts ranging from about 9 to about 22 grams of cleaning composition.

A cleaning, composition according to another embodiment includes a surfactant system selected from the group consisting of a nonionic surfactant; an anionic or amphoteric surfactant; a nonionic surfactant in combination with an anionic or amphoteric surfactant; a nonionic surfactant in combination with an anionic or amphoteric polymer with dispersing property; an amphoteric surfactant in combination with an anionic surfactant; an anionic or amphoteric surfactant in combination with an anionic or amphoteric polymer with dispersing property; and combinations thereof; a solvent system comprising a humectant; and optionally water present in an amount from 0 to about 55 wt % based on the total weight of the cleaning composition; wherein the cleaning composition is in a form of a continuous phase; with the following provisos: (a) when the surfactant system contains a nonionic surfactant in combination with an anionic surfactant, the weight ratio of the nonionic surfactant to the anionic surfactant is from about 1:1 to about 4:1, and water is present in an amount from about 10 to about 55 wt % based on the total weight of the cleaning composition, and (b) the cleaning composition is characterized as exhibiting about a constant cleaning efficacy as measured using test procedure ASTM D4265 when the cleaning composition is added to 69 liters of exterior water in amounts ranging from about 9 to about 22 grams of cleaning composition.

Methods for pretreating and cleaning laundry and nontextile surfaces are also presented.

Other aspects and embodiments of the present invention will become apparent from the following detailed description, which, when taken in conjunction with the drawings, illustrate by way of example the principles of the invention.

DESCRIPTION

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The term "or" or "and/or" is used as a function word to indicate that two words or expressions are to be taken together or individually. The terms "comprising," "having," "including," and "containing" are to be construed as open-ended terms (i.e., meaning "including, but not limited to"). The endpoints of all ranges directed to the same component or property are inclusive and independently combinable.

As will soon become apparent, several embodiments of the present cleaning composition surprisingly provide excellent cleaning efficacy with lower active doses of cleaning ingredients, e.g., less than about 22 grams of cleaning composition per 69 liters of wash water (referred to herein as "external water"). Also surprisingly, the cleaning efficacy of some embodiments is relatively flat across a variety of concentrations. These results were not expected. Rather, one would not expect effective cleaning at the dosages disclosed herein. Moreover, one would expect the cleaning efficacy to change significantly with increasing concentration of cleaning ingredients, as is observed in compositions currently on the market.

In addition, the inventors have surprisingly and unexpectedly discovered that some embodiments of the present invention have a low viscosity, where a higher viscosity at the disclosed concentrations was expected.

Figure 1:
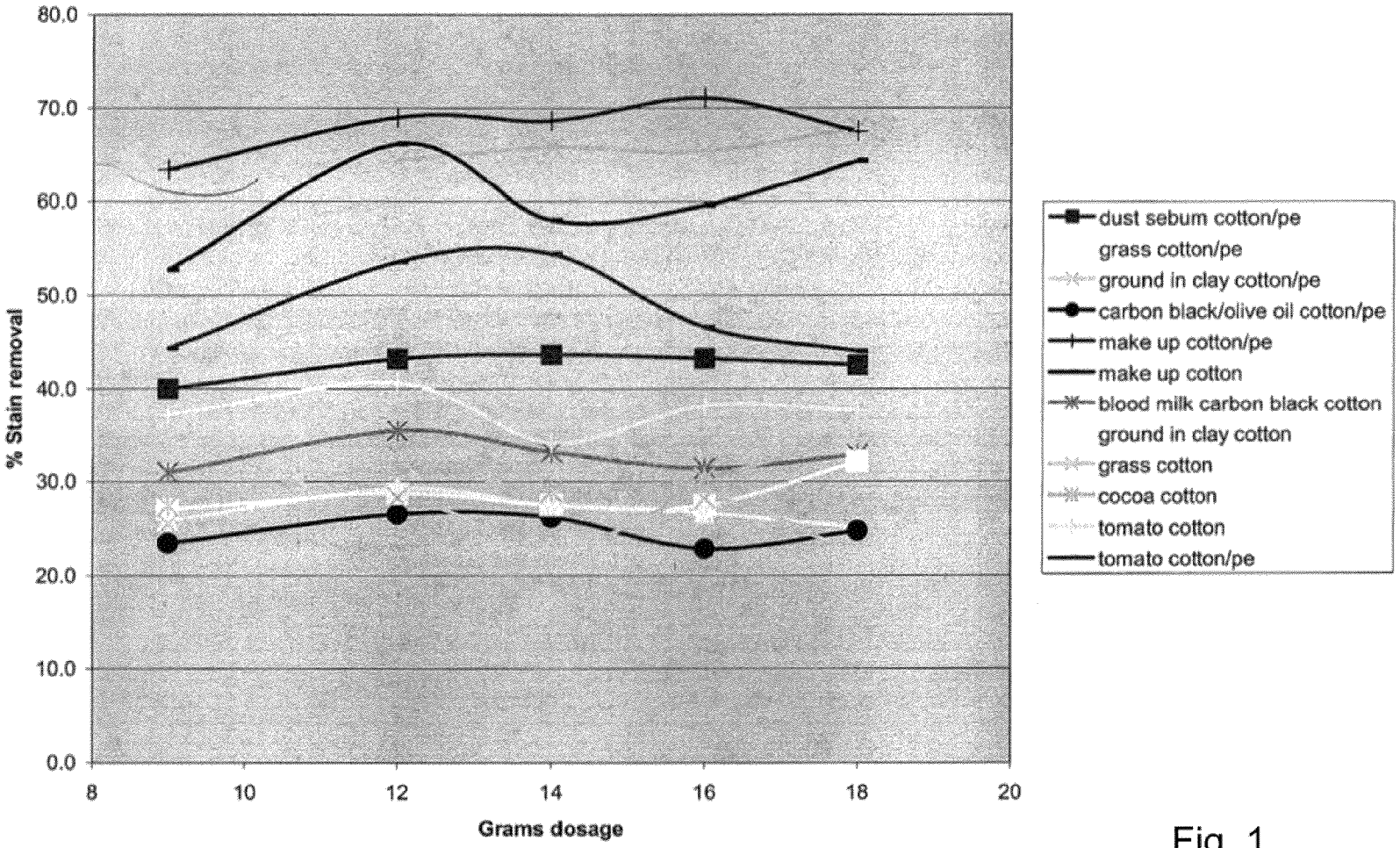
FIG. 1 is a graph showing the non-linear relationship between the dosing concentration of the present cleaning composition and the cleaning performance.

Thus, embodiments of the cleaning compositions exhibiting the unexpected results provide several advantages over known compositions, including but not limited to the ability to create an efficacious cleaning composition in a highly concentrated form (e.g., 4×, preferably 5×, more preferably 6× Concentrates), thereby minimizing packaging requirements and energy consumption for packaging and shipping; lower quantities of actives are required per washload, reducing the cost of the products, as well as minimizing the amount of cleaning actives added to sewer and septic systems and the environment; less packaging to recycle or add to landfills; etc. Moreover, the low viscosity of some embodiments coupled with low dosage requirements enable pump dispensing of said embodiments of the present cleaning composition. FIG. 1 shows the cleaning efficacy of an illustrative cleaning composition according to one embodiment in terms of percent of stain removed as a function of grams of cleaning composition added to 69 liters of water, which is the amount of water used by a typical standard washing machine for a standard load. The percent stain removal is determined according to ASTM D4265 "Standard Guide for Evaluating Stain Removal Performance in Home Laundering" using a colorimeter that measures in the L, a, b, spaces and calculates Y in National Bureau of Standards X, Y, Z, space. Y value is used for the calculation is as follows:

AVERAGE PERCENT STAIN/SOIL REMOVAL= (Average Final *Y* Reading−Average *Y* Initial Reading)×100/(99.9−Average Initial Reading)

FIG. 1 is representative of what has been observed in some embodiments of the cleaning compositions described herein. As indicated by FIG. 1, there is no linear relationship between the concentration and/or dosage amount of some embodiments of the present cleaning composition and the stain removal performance. Rather, as shown in FIG. 1, the cleaning efficacy of the illustrative cleaning compositions is substantially flat (e.g., stain removal does not vary by more than 10%, preferably 5% in the y-axis) across a range of dosages, and for a variety of soils and stains.

In addition, the outstanding cleaning performance of embodiments of the present composition can be maintained with minimal agitation or heat. As noted above, one would have expected the cleaning efficacy to change significantly with increasing concentration of cleaning ingredients, as is observed in compositions currently on the market. Without to be bound by any theory, it is believed that the surprisingly flat response as represented in FIG. 1 is likely indicative of: 1) strong surface adsorption to the clothing and soil or stain soon after introduction of the cleaning composition to the wash water, 2) followed by direct interaction with the soil or stain, and 3) finally culminating in dilution with water. This is a very different mechanism than is typically observed of detergent compositions currently in use. Such existing detergent compositions: 1) deploy to water first, 2) contact the surface of the clothing and soil or stain by agitation/impact, 3) the micelles break to deploy, 4) the micelles directly interact with the soil or stain, and 5) finally culminating in dilution with water.

Accordingly, as compared to conventional cleaning compositions, the present composition has enhanced cleaning performance with lesser amounts of detergent and with moderate or no agitation and/or heat during use. Since the present cleaning composition does not contain excessive amount of water as the conventional compositions do, it is more efficient, in terms of time and energy consumptions, to package, ship, and use the present cleaning composition. Moreover, lesser agitation and heat during cleaning reduces energy consumption as well as attendant substrate damage, e.g., damage to the clothing being cleaned. Further, because the cleaning efficacy is flat across a range of concentrations, a lesser amount of active ingredients is required per load, i.e., less of the cleaning composition need be added per load of laundry.

Embodiments generally showing the foregoing unexpected results include a surfactant system comprising a nonionic surfactant in combination with an anionic surfactant; water present in an amount from 0 to about 40 wt % (where "about X wt %" means "X±3 wt %") based on a total weight of the cleaning composition; a solvent system comprising a polyalcohol, the solvent system being present in an amount effective to solubilize the surfactant system in the water; and an enzyme present in an amount of less than about 15 wt %. The cleaning composition is preferably in the form of a continuous phase. Moreover, the cleaning composition is characterized as exhibiting about a constant cleaning efficacy (i.e., not varying by more than about 10% between highest and lowest values across the range when cleaning efficacy is measured in terms of % stain removal (e.g., high and low values are 40% and 50%, respectively), more preferably not varying by more than about 5%) as measured using test procedure ASTM D4265 when the cleaning composition is added to 69 liters of exterior water in amounts ranging from about 9 to about 22 grams of cleaning composition, and about 9 to about 18 grams (where "about X grams" means "X±1 gram") of cleaning composition.

In one embodiment, the present composition has the same or similar cleaning performance with the dosage amount that is half of that of a conventional cleaning composition such as TIDE 2X liquid laundry detergent, sold by Procter & Gamble. In one embodiment, the present composition has the same or similar cleaning performance with the dosage amount that is one third of that of a conventional cleaning composition. In one embodiment, the present composition has the same or similar cleaning performance with the dosage amount that is one fourth of that of a conventional cleaning composition. In one embodiment, the present composition has the same or similar cleaning performance with the dosage amount that is one fifth of that of a conventional cleaning composition. In one embodiment, the present composition has the same or similar cleaning performance with the dosage amount that is one sixth of that of a conventional cleaning composition.

In one embodiment, the present invention includes a cleaning composition comprising a surfactant system; a solvent system; and optionally water; wherein the cleaning composition is in a form of a continuous phase, and water is present in an amount from 0 to about 55 wt % (e.g., 55±2 wt %) based on the total weight of the cleaning composition. The surfactant system comprises a nonionic surfactant in combination with an anionic surfactant. The solvent system is present in an amount effective to solubilize the surfactant system in the water (if present), i.e., the solvent system is present in an amount effective to push the surfactant system through its gel phase and to solubilize in the water. The term "continuous phase" denotes a liquid wherein a dispersant or cleaning system (e.g. surfactant system) is suspended. The term "liquid" includes solution, suspension, dispersion, emulsion, and the like. Preferably, the continuous phase is a water-in-oil emulsion, i.e., an "invert emulsion". In one preferred embodiment, the water is present in an amount from about 5 to about 50 wt %. One particularly preferred solvent system comprises a polyalcohol.

In one embodiment, the present invention includes a cleaning composition comprising a surfactant system; a solvent system, and optionally water; wherein the cleaning composition is in a form of a continuous phase, and water is present in an amount from 0 to about 55 wt % (e.g., 55±2 wt %) based on the total weight of the cleaning composition. In one preferred embodiment, water is present in an amount from about 5 to about 50 wt %. The surfactant system is selected from the group consisting of an nonionic surfactant; an amphoteric surfactant; a nonionic surfactant in combination with an anionic surfactant; an anionic surfactant in combination with an anionic polymer with dispersing property; an amphoteric surfactant in combination with an anionic surfactant; an amphoteric surfactant in combination with an anionic polymer with dispersing property; and combinations thereof. The solvent system comprises a polyalcohol. Preferably, the continuous phase is a water-in-oil emulsion, i.e., an "invert emulsion".

It is preferred that when the surfactant system contains a nonionic surfactant in combination with an anionic surfactant, the weight ratio of the nonionic surfactant to the anionic surfactant is from about 1:1 about 4:1, and water is present in an amount from about 10 to about 55 wt % based on the total weight of the cleaning composition. It is also preferred that when the surfactant system contains an amphoteric surfactant and does not contain any anionic surfactant or anionic polymer with dispersing property, the exterior pH for the cleaning composition is from about 7 to about 12. It is also preferred that when the surfactant system contains an amphoteric surfactant in combination with an anionic surfactant or an anionic polymer with dispersing property, the exterior pH for the cleaning composition is from about 7 to about 12. The "exterior pH" refers to the pH of the water to which the cleaning composition is added, e.g., in a consumer's washing machine.

The cleaning performance of some embodiments of the present cleaning compositions can be adjusted for the intended use by modulating the water content and the solvent system. In certain instances, the surfactant molecules of the present composition either form "invert micelles" or do not aggregate to form any micelles at all. By "invert micelles," it is meant water-in-oil type of micelles wherein the lipophilic region of the surfactant molecule points outward, while the hydrophilic region of the surfactant molecule points toward the center of the micelle and are in contact with water. During the cleaning process, the active ingredients in the present composition gets to the surface to be cleaned very quickly with minimal dilution, or without the dilution step.

In one embodiment of the present invention, the cleaning composition comprises a nonionic surfactant; an anionic surfactant; a solvent system comprising a polyalcohol; and water; wherein the weight ratio of the nonionic surfactant to the anionic surfactant is from about 1 to about 4, and water is present in an amount from about 10 to about 55 wt % based on the total weight of the cleaning composition. In another embodiment, water is present in an amount from about 10 to about 45 wt %. In another embodiment, water is present in an amount from about 15 to about 40 wt %. In another embodiment, water is present in an amount from about 20 to about 35 wt %.

As used herein, "water" refers to "total water", which is meant to include both the water molecules that can freely move around in the cleaning composition, i.e., "free water," and the water molecules the movement or activity of which is substantially weakened or reduced by their interaction with other ingredients. In other words, free water refers to the portion of the total water available to behave as water in solubilizations (solvent actions) or in hydrolyses. The present cleaning composition has very low free water concentration, i.e., very low water activity, because much or all of the total water is tied up or "locked" by the surfactant system and the solvent system. Thus, in some embeds having substantially no free water, when a water-soluble capsule is used to encapsulate the cleaning composition, such a capsule would not be dissolved by the present composition due to its low water activity. Low water activity also favors the deployment of surfactants to surfaces for the removal of stains when the present cleaning composition is diluted by a large amount of water during use. White the water activity is very low in the present cleaning composition, the total water content is preferably maintained to an appropriate level to avoid potential problems. For example, when the total water content is extremely low, moisture from the environment may diffuse into the cleaning composition through a water soluble film, thereby undermining the integrity of the product. Furthermore, the total water content may need to be at a certain level to dissolve or stabilize some water soluble builders and surfactants, such as anionic surfactants.

In another embodiment, the weight ratio of the nonionic surfactant to the anionic surfactant is from about 1.25:1 to about 3.50:1. In another embodiment, the weight ratio of the nonionic surfactant to the anionic surfactant is from about 1.40:1 to about 3.25:1. In another embodiment, the weight ratio of the nonionic surfactant to the anionic surfactant is from about 1.50:1 to about 2.75:1. In another embodiment, the weight ratio of the nonionic surfactant to the anionic surfactant is about 2:1.

In another embodiment, the anionic surfactant can be replaced partially or entirely with an anionic polymer with dispersing property. That is, in one embodiment, the cleaning composition comprises a nonionic surfactant; a mixture of an anionic surfactant and an anionic polymer with dispersing property; a solvent system comprising a polyalcohol; and water. Preferably, the weight ratio of the nonionic surfactant to the mixture of the anionic surfactant and the anionic polymer with dispersing property is from about 1 to about 4, and water is present in an amount from about 5 to about 55 wt % based on the total weight of the cleaning composition. In another embodiment, the cleaning composition comprises a nonionic surfactant; an anionic polymer with dispersing property; a solvent system comprising a polyalcohol; and water. Preferably, the weight ratio of the nonionic surfactant to the anionic polymer with dispersing property is from about 1 to about 4, and water is present in an amount from about 5 to about 55 wt % based on the total weight of the cleaning composition. When used together as a mixture, the anionic surfactant and the anionic polymer with dispersing property can be in any weight or molar ratio.

In yet another embodiment, the cleaning composition does not contain an anionic surfactant nor an anionic polymer with dispersing property. That is, the cleaning composition comprises a nonionic surfactant; a solvent system comprising a polyalcohol; and water. Preferably, water is present in an amount from about 5 to about 55 wt % based on the total weight of the cleaning composition.

In yet another embodiment, the nonionic surfactant can be replaced partially or entirely with an amphoteric surfactant. That is, in one embodiment, the cleaning composition comprises an amphoteric surfactant; an anionic surf an anionic polymer with dispersing property, or a mixture thereof; a solvent system comprising a polyalcohol; and water. Preferably, water is present in an amount from about 5 to about 55 wt % based on the total weight of the cleaning composition. In another embodiment, the cleaning composition comprises a mixture of a nonionic surfactant and an amphoteric surfactant; an anionic surfactant, an anionic polymer with dispersing property, or a mixture thereof; a solvent system comprising a polyalcohol; and water. Preferably, water is present in an amount from about 5 to about 55 wt % based on the total weight of the cleaning composition. When used together as a mixture, the nonionic surfactant and the amphoteric surfactant can be in any weight or molar ratio. When used together as a mixture, the anionic surfactant and the anionic polymer with dispersing property can be in any weight or molar ratio. It is also preferred that the weight ratio of the nonionic surfactant, the amphoteric surfactant, or a mixture thereof to the anionic surfactant, the anionic polymer with dispersing property, or a mixture thereof is from about 1 to about 4.

By "nonionic surfactants," it is meant surfactants that do not contain any ionic groups. Examples of suitable nonionic surfactants include ethoxylated alcohols including alkyl poly (ethylene oxide) and alkylphenol poly(ethylene oxide); copolymers of poly(ethylene oxide) and poly(propylene oxide), a.k.a. Poloxamers or Poloxamines; alkyl polyglucosides, e.g., dodecyl glucoside, octyl glucoside), and decyl maltoside; fatty alcohols, e.g.) cetyl alcohol and oleyl alcohol; cocamide MEA; cocamide DEA; polysorbates, e.g. Tween 20, Tween 80, and dodecyl dimethylamine oxide.

in one embodiment, the nonionic surfactants include an ethoxylated alcohol including fatty alcohol ethoxylate. In another embodiment, the ethoxylated alcohol has the formula: $R^1(OC_2H_4)_nOH$, wherein $R^1$ is a hydrocarbon group, and it is an integer from 2 to 12. Preferably, n is an integer from 3 to 9. The term "hydrocarbon" denotes an organic compound containing only carbon and hydrogen. In one embodiment, the hydrocarbon group is an aliphatic group. By "aliphatic," it is meant hydrocarbon having carbon atoms linked in open chains. Examples of aliphatic groups include, but are not limited to alkyl, alkenyl, and alkynyl groups. In one embodiment, $R^1$ is an aliphatic group having 6 to 22 carbon atoms. In another embodiment, $R^1$ is an alkyl group having 8 to 20 carbon atoms.

in another embodiment, the nonionic surfactants include an ethoxylated fatty acid ester. The fatty acid preferably has 8 to 18 carbon atoms with 10 to 14 carbon atoms more preferred. Examples of the ethoxylated fatty acid ester include ethoxylated fatty acid methyl ester, such as coco methyl ester ethoxylate and palm methyl ester ethoxylate.

In one embodiment, the nonionic surfactant is present in an amount from about 10 to about 60 wt % based on the total weight of the cleaning composition. In another embodiment, the nonionic surfactant is present in an amount from about 12.5 to about 55 wt %. In another embodiment, the nonionic surfactant is present in an amount from about 15 to about 50 wt %. In another embodiment, the nonionic surfactant is present in an amount from about 17.5 to about 45 wt %. In another embodiment, the nonionic surfactant is present in an amount from about 20 to about 40 wt %. In another embodiment, the nonionic surfactant is present in an amount from about 25 to about 35 wt %.

By "anionic surfactants," it is meant surfactants containing one or more anionic groups and having net negative charges. Illustrative anionic surfactants may be based on sulfate, sulfonate or carboxylate anions, examples of which include, but are not limited to perfluorooctanoate (PFOA or PFO); perfluorooctanesulfonate (PFOS); sodium dodecyl sulfate (SDS), ammonium lauryl sulfate, and other alkyl sulfate salts; sodium laureth sulfate, also known as sodium tauryl ether sulfate (SLES); alkyl benzene sulfonate; and fatty acid salts.

In one embodiment, the anionic surfactant is a sulfonate salt and/or a sulfate salt, each of which independently contains an organic radical having 6 to 22 carbon atoms. In one embodiment, the organic radical is selected from the group consisting of a fatty acid group or a salt thereof, an ester of a fatty acid group, an alkyl group, an alkenyl group, an alkyl ether group, an alkenyl ether group, and a mixture thereof. In one embodiment, the sulfonate salt and/or sulfate salt is independently an alkali metal salt, such as sodium salt, or an ammonium or amine salt.

Useful anionic surfactants may also include water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxy late moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Also useful are linear straight chain alkylbenzene sultanates in which the average number of carbon atoms in the alkyl group is from about 11 to 13, abbreviated as $C_{11}$-$C_{13}$ LAS.

In one embodiment, the anionic surfactant is present in an amount from about 5 to about 55 wt % based on the total weight of the cleaning composition. In another embodiment, the anionic surfactant is present in an amount from about 6 to about 50 wt %. In another embodiment, the anionic surfactant is present in an amount from about 7 to about 45 wt %. In another embodiment, the anionic surfactant is present in an amount from about 8 to about 40 wt %. In another embodiment, the anionic surfactant is present in an amount from about 10 to about 35 wt %. In another embodiment, the anionic surfactant is present in an amount from about 12 to about 30 wt %. In another embodiment, the anionic surfactant is present in an amount from about 13 to about 20 wt %.

The term "an anionic polymer with dispersing property" denotes a polymer which contains an anionic group and has the property of preventing the redeposition of detached soil or dirt on the surface being cleaned, and also preventing the flocculation of soil or dirt particles into larger, precipitating aggregates, and thereby keeping the particles suspended in a working solution. Examples of the anionic polymer with dispersing property is selected from the group consisting of sodium carboxymethyl cellulose (CMC), salts of polyaspartic acid, and salts of polyacrylic acid and/or maleic acid.

As used herein, the terms "amphoteric surfactant" and "zwitterionic surfactant" are used interchangeably and denote a surfactant containing both positive charge (e.g., cationic group) and negative charge (e.g., anionic group) and carrying a total net charge of zero. Examples of amphoteric surfactant include, but are not limited to dodecyl betaine, cocamidopropyl betaine, coco ampho glycinate, and combinations thereof. When the amphoteric surfactant is used in the cleaning composition, it is preferred that the exterior pH for the cleaning composition is from about 7 to about 12, with the pH from about 8 to about 11 more preferred and the pH from about 9 to about 10 most preferred.

The term "humectant," as used herein, refers to a hygroscopic substance. For example, the humectant can be a compound containing multiple hydrophilic groups, such as hydroxyl, amine, carboxyl, esterified carboxyl, and combinations thereof. Examples of humectants include glycerine, propylene glycol, and glyceryl triacetate. Others can be polyols, such as sorbitol, xylitol and maltitol, or polymeric polyols, such as polydextrose or natural extracts like quillaia, or lactic acid or urea. Preferably, the humectant is a polyalcohol. By "polyalcohol," it is meant an organic compound containing multiple hydroxyl groups, particularly the organic compounds having an alkyl backbone. Examples of polyalcohol include ethylene glycol, glycerin, polyethylene glycol (PEG), and the like. In one embodiment, the solvent system further comprises a methyl ether of a polyalcohol. That is, the solvent system comprises a polyalcohol and a methyl ether of a polyalcohol. In another embodiment, in addition to the polyalcohol and the methyl ether of a polyalcohol, the solvent system further comprises an ingredient selected from the group consisting of a methyl ester of a fatty acid, an alcohol, water, and a mixture thereof. In one specific embodiment, the solvent system comprises a polyalcohol, a methyl ether of a polyalcohol, a methyl ester of a fatty acid, and an alcohol. In one example, the methyl ether of a polyalcohol is 1,3 propanediol. In another example, the methyl ester of a fatty acid is coco methyl ester. In yet another example, the alcohol is ethanol or methanol.

In one embodiment, the solvent system is present in an amount from about 1.5 to about 55 wt % based on the total weight of the cleaning composition. In another embodiment, the solvent system is present in an amount from about 5 to about 30 wt %. In another embodiment, the solvent system is present in an amount from about 9 to about 22 wt %. In one embodiment, the weight ratio of the polyalcohol and the methyl ether of a polyalcohol is from about 1.0 to about 2.7. In another embodiment, the weight ratio of the polyalcohol and the methyl ether of a polyalcohol is from about 1.4 to about 2.5.

The present cleaning composition may further comprise an additive such as a digestive enzyme, an enzyme stabilizer, a fragrant agent, a non-phosphate builder, an antiredeposition agent, a booster, and/or other additives. To achieve the desired cleaning performance and/or stability, the amount and ratio of various ingredients of the surfactant system and a solvent system as well as the amount of water can be adjusted in view of the a digestive enzyme, an enzyme stabilizer, a fragrant agent, a non-phosphate builder, an antiredeposition agent, a booster, and/or other additives. Thus, though ranges are presented by way of example herein, the actual amount of additive may be higher or lower than the range.

In one embodiment, the present cleaning composition further comprises a digestive enzyme. The digestive enzymes can be any enzyme found in the alimentary tract of a human or animal that breaks down food or other organic materials so that the host organism can absorb it. Examples of the digestive enzyme include, but are not limited to one or more protease enzymes, one or more amylase enzymes, one or more cellulase enzymes, one or more lipase enzymes, one or more manninase enzymes, and combinations thereof. Examples of suitable enzymes include, but are not limited to, hemicellulases, peroxidases, proteases, other cellulases, xylanases, lipases, phospholipases, esterases, eutinases, peetinases, marmanases, pectate lyases, keratinases, reductases, oxidases, phenoloxidases, lipoxygenases, ligninases, pullulanases, tannases, pentosanases, malanases, β-glueanases, arabinosidases, hyaluronidase, chondroitinase, laccase, and amylases, or mixtures thereof. In one embodiment, the digestive enzyme is present in an amount from about 0 to about 12 wt % based on the total weight of the cleaning composition. In another embodiment, the digestive enzyme is present in an amount from about 2 to about 10 wt %. In another embodiment, the digestive enzyme is present in an amount from about 3 to about 8 wt %.

In one embodiment, the present cleaning composition further comprises an enzyme stabilizer, i.e., a substance to stabilize the digestive enzyme. Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability. In one embodiment, the enzyme stabilizer is present in an amount from about 0 to about 2 wt % based on the total weight of the cleaning composition. In another embodiment, the enzyme stabilizer is present in an amount from about 0.001 to about 1 wt %. In another embodiment, the enzyme stabilizer is present in an amount from about 0.01 to about 0.1 wt %.

In another embodiment, the cleaning composition may contain one or more additional components that may tint articles being cleaned, such as a fluorescent whitening agent. Any fluorescent whitening agent suitable for use in a laundry detergent composition may be used in the composition of the present invention. The most commonly used fluorescent whitening agents are those belonging to the classes of diaminostilbene-sulphonic acid derivatives, diarylpyrazoline derivatives and bisphenyl-distyryl derivatives. In one embodiment, the additional component is present in an amount from about 0 to about 2 wt % based on the total weight of the cleaning composition. In another embodiment, the additional component is present in an amount from about 0.001 to about 1 wt %. In another embodiment, the additional component is present in an amount from about 0.005 to about 0.1 wt %.

In one embodiment, the cleaning composition further comprises a fragrant agent, e.g., a compound or ingredient which imparts a pleasant smell to the cleaning composition. Any fragrant agent known in the aft can be used. In one embodiment, the fragrant agent is present in an amount from about 0 to about 5 wt % based on the total weight of the cleaning composition. In another embodiment, the fragrant agent is present in an amount from about 0.01 to about 2 wt %. In another embodiment, the fragrant agent is present in an amount from about 1 to about 2 wt %.

In one embodiment, the present cleaning composition further comprises a builder, preferably a non-phosphate builder. The non-phosphate builder may be an organic or inorganic substance. Examples of non-phosphate builder include, but are not limited to sodium carbonate, calcium carbonate, calcium chloride, magnesium carbonate, ethylenediaminetetraacetic acid (EDTA), nitriloacetic acid (NTA), borates, zeolites, alkyl or hydroxyalkyl cellulose derivatives, and combinations thereof. Preferably, the non-phosphate builder is an alkyl cellulose derivative, hydroxyalkyl cellulose derivative, carboxyalkyl cellulose derivative, or a combination thereof. Alkyl, hydroxyalkyl, carboxyalkyl cellulose derivatives are cellulose chemically modified by alkyl, hydroxyalkyl, or carboxyalkyl groups. Examples of an alkyl, hydroxyalkyl, and carboxyalkyl cellulose derivatives include, but are not limited to methyl cellulose, hydroxypropyl ether cellulose, carboxy methyl ether cellulose or its alkali salt or a mixture thereof, and a combination thereof. In one embodiment, the builder is present in an amount from about 0 to about 15 wt % based on the total weight of the cleaning composition.

In one embodiment, the present cleaning composition further comprises an antiredeposition agent. By "antiredeposition agent," it is meant additive used in the cleaning composition to help prevent soil from resettling on a surface after it has been removed during cleaning. Anti-redeposition agents are typically water-soluble and are sometimes negatively charged. In one embodiment, the antiredeposition agent is a cellulose acetate based polymeric material, for example, carboxymethyl cellulose (CMC), hydroxypropyl methylcellulose (HPMC), and the like. Other examples of antiredeposition agent includes, but are not limited to polyvinylpyrrolidone, poly-4-vinylpyridine-N-oxide (PVnO), polyvinyl acetate, polyvinyl alcohol, and the like. Dependent on the intended use and the desired performance, the fragrant agent, the non-phosphate builder, and the antiredeposition agent may be in various percentages and ratios in the cleaning composition.

In yet another embodiment, the present cleaning composition further comprises a booster. A "booster" is an additive used in the cleaning composition to improve or "boost" the cleaning efficacy of the active cleaning ingredients in the cleaning composition. Some boosters condition water to make detergents work more effectively. In one approach, the booster is or includes an alkalinity agent that causes the water to which it is added to become more alkaline. Illustrative boosters include borates such as sodium borate decahydrate (also known as "borax"), which has many chemical properties that contribute to its cleaning power. Sodium borate decahydrate and other borates clean and bleach by converting some water molecules to hydrogen peroxide ($H_2O_2$). This reaction is more favorable in hotter water. The pH of sodium borate decahydrate is about 9.5, so it produces a basic solution in water, thereby increasing the effectiveness of bleach and other cleaning ingredients. In other embodiments, the booster is a metal carbonate such as sodium carbonate.

Although not critical to its intended use and performance, it is preferred that the cleaning composition is compatible with external additives, i.e., additives that are added to a laundry or surface to be cleaned by a consumer separately from the cleaning composition. Illustrative external additives include boosters, water softening compositions, alkalinity agents, vinegar, baking soda, etc.

Although not critical to its intended use and performance, it is preferred that the cleaning composition is environmentally friendly. In particularly preferred embodiments, the cleaning composition does not comprise any ingredient that is not environmentally friendly. As used herein, the cleaning composition or ingredient thereof is considered to be environmentally friendly if it meets one or more of the following conditions. For example, it is preferred, although not critical, that the cleaning composition contains material derived from natural, and/or sustainable (e.g., renewable) sources, and not petroleum. It is also preferred, although not critical, that all the ingredients of the cleaning composition can be degraded through biological or natural processes. In one approach, all ingredients and the finished formula is considered readily biodegradable according to the OECD 301F biodegradability standard. It is also preferred, although not critical, that none of the ingredients of the cleaning composition are known to appreciably accumulate in the environment and/or in animals.

In one embodiment of the present invention, the cleaning composition comprises one or more nonionic surfactants in an amount ranging from about 13 to about 58 wt %, with from about 22 to about 44 wt % preferred, and from about 24 to about 39 wt % more preferred; one or more anionic surfactants in an amount ranging, from about 10 to about 50 wt %, with from about 12 to about 35 wt % preferred, and from about 13 to about 22 wt % more preferred; one or more polyalcohol in an amount ranging from about 3 to about 26 wt %, with from about 8 to about 20 wt % preferred, and from about 12 to about 18 wt % more preferred; an alcohol in an amount ranging from about 0 to about 8 wt %, with from about 0 to about 4 wt % preferred, and from about 0 to about 2 wt % more preferred; a methyl ether of a polyalcohol in an amount ranging from about 0 to about 10 wt %, with from about 2 to about 7 wt % preferred, and from about 3 to about 5 wt % more preferred; a methyl ester of a fatty acid in an amount ranging from about 0 to 25 about 6 wt %, with from about 0 to about 4 wt % preferred, and from about 0 to about 3 wt % more preferred; added water in an amount ranging from about 0 to about 10 wt %, with from about 0 to about 5 wt % preferred, and from about 0 to about 2 wt % more preferred; one or more fragrance agents in an amount ranging from about 0 to about 4 wt %, with from about 0 to about 2.5 wt % preferred, and from about 0 to about 2 wt % more preferred; one or more digestive enzymes in an amount ranging from about 0 to about 11 wt %, with from about 2.5 to about 9.5 wt % preferred, and from about 5 to about 8 wt % more preferred; one or more enzyme stabilizers in an amount ranging from about 0 to about 5 wt %, with from about 0 to about 3 wt % preferred, and from about 0 to about 2 wt % more preferred; and antiredeposition agents in an amount ranging from about 0 to about 2 wt %, with from about 0 to about 1 wt % preferred, and from about 0 to about 0.5 wt % more preferred. In one illustrative embodiment, the one or more nonionic surfactants are a combination of sodium sulfonate mixture of a fatty acid or an ester of a fatty acid and sulfonate of secondary alkane, wherein the sodium sulfonate mixture of a fatty acid or an ester of a fatty acid is in an amount from about 10 wt % to about 30 wt % and sulfonate of secondary alkane is in an amount from about 0 wt % to about 20 wt %; the one or more anionic surfactants are a combination of one or more fatty alcohol ethoxylates and one or more ethoxylated fatty acid methyl esters, wherein the fatty alcohol ethoxylates is in an amount from about 13 wt % to about 38 wt % and the ethoxylated fatty acid methyl ester is in an amount from about 0 wt % to about 20 wt %; and the one or more polyalcohol is a combination of 1,3-propanediol and glycerin, wherein 1,3-propanediol is in an amount from about 0 wt % to about 5 wt % and glycerin is in an amount from about 3 wt % to about 11 wt %. In another example of the embodiment, the alcohol is ethanol; the methyl ester of a polyalcohol is dipropylene glycol methyl ester; and the methyl ester of a fatty acid is coco methyl ester. In another example of the embodiment, the one or more digestive enzymes are a combination of various subtilisin proteases; and the enzyme stabilizer is CaCl (30% aqueous solution). In another example of the embodiment, the non-phosphate builder is sodium polyaspartate; and the antiredeposition agent is a biodegradable polyester, such as Clariant Texcare SRN 240. Additional nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

Unlike conventional liquid cleaning compositions, which contain preservatives to inhibit microbial growth therein, various embodiments of the present cleaning composition do not require the presence of any preservative. In some embodiments, the present cleaning composition does not contain any preservative. As used herein, "preservative" is a compound that is added to the cleaning composition to inhibit microbial growth.

In other embodiments, the present cleaning composition contains a preservative to inhibit microbial growth. For example, preservatives may optionally be included in various embodiments as a way to further boost microbial protection for gross bacteria, virus and/or fungi contamination introduced e.g., by a consumer, through a contaminated ingredient, contaminated storage container, equipment, processing step or other source. Any conventional preservative known in the art may be used. Some illustrative preservatives include: potassium sorbate, sodium benzoate, benzoic acid, phenoxyethanol, benzyl alcohol, dehydoxyacetic acid, sodium borate, boric acid, usinic acid, phenols, quaternary ammonia compounds, glycols, isothiazolinones (methyl, benzyl, chloro), DMDM hydantoin, hexidine, ethanol, polyaminopropyl biguanide, phenylphenol, imidazolidinyl urea, iodopropynyl butyl carbamate, parabens, formaldehyde, salicylic acid or salts, caprylyl glycol, D-glucono-1,5 lactone, sodium erythorbate, sodium hydroxymethylglycinate, peroxides, sodium sulfite, bisulfite, glucose oxidase, lacto peroxidase, and other preservatives compatible with the cleaning ingredients. Some other natural materials might also be considered like cinnamon, fruit acids, essential oils like thyme and rosemary, willow bark, aspen bark, tocopherol, curry, citrus extracts, honeysuckle, and amino acid based preservatives. Especially preferred are preservatives that do not compete with the cleaning ingredients (cationic materials) and do not have reported health or environmental issues (parabens, formaldehyde etc.). Some of the more preferred preservatives are: phenoxyethanol, benzoic acid/potassium sorbate, enzymes, borates and the natural solutions above. In one embodiment, the preservative is present in an amount less than about 5 wt % based on the total weight of the cleaning composition. In another embodiment, the preservative is present in an amount from about 0.01 to about 2 wt %. In another embodiment, the fragrant agent is present in an amount from about 0.01 to about 1 wt %.

In one embodiment, the present cleaning composition has a viscosity of about 200 centipoise (e.g., 200±20 cp) or less at 23° C. in another embodiment, the present cleaning composition has a viscosity of less than about 100 centipoise. In yet another embodiment, the present cleaning composition has a viscosity of less than about 50 centipoise. As noted above, the inventors have surprisingly and unexpectedly discovered that some embodiments of the present invention have such a low viscosity. This result was contrary to what was expected, i.e., what was expected was a higher viscosity at the disclosed concentrations of components.

Table 1 sets forth illustrative formulation parameters that provide cleaning compositions characterized as exhibiting about a constant cleaning efficacy as measured using the aforementioned test procedure when the cleaning composition is added to 69 liters of exterior water in amounts ranging from about 9 to about 22 grams of cleaning composition. One practicing the present invention using formulations derived from Table 1 should obtain results similar to those shown in the FIGS. appended hereto.

TABLE 1

Cleaning Composition A

| Ingredients | Wt. Percentage Range |
|---|---|
| Water | 4-10 |
| LAE 24-7 | 25-30 |
| Dipropylene glycol methyl ether | 2-5 |
| Ethanol | 0-2 |
| Stilbene brightener | .01-.05 |
| LAE 24-3 | 1-2 |
| polyalcohols | 6-8 |
| Methyl ester | 0.5-1 |
| Methyl ester ethoxylates | 4-7 |
| Methyl ester sulfonate 40% aqueous | 35-40 |
| Fragrance | 1-2 |
| Protease Liquid | 3-6 |
| Amylase Liquid | 1-4 |
| Antiredeposition agent | 0.5-1 |
| CaCl2 | 0-0.5 |
| Enzyme preservative | qs |

One practicing the present invention sing formulations derived from Table 1 should obtain results similar to those shown in the FIGS. appended hereto. FIG. 1 has already been discussed.

In one embodiment, the present invention provides a water-soluble or water-rupturable capsule encapsulating the present cleaning composition. "Water-soluble" or "water-rupturable," as used interchangeably herein describes a capsule which can be dissolved or broken apart upon contacting with sufficient amount of free water to thereby discharge the present cleaning composition or expose the present cleaning composition to water in the surrounding, environment. The water-soluble capsule can be made from any water-soluble material in a method known to one skilled in the art. By "water-soluble material" it is meant any substance that readily dissolves or ruptures in free water. The water-soluble material can be a polymeric material or non-polymeric material. Examples of suitable water-soluble material include, but are not limited to, polyvinyl alcohol, polyethylene oxide, methyl cellulose, partially hydrolyzed polyvinyl acetate, alginates, gelatin, carageenan, cellulosics, and combinations thereof. The water-soluble material may be used in plasticized form. That is, the water-soluble material may be mixed or treated with plasticizers, such as, for example, glycerin, sorbitol, and the like. Films of polyvinyl alcohol are most preferred. The invention encompasses the use of materials having water solubilities ranging from partial solubility in hot water to complete solubility in cold water. Moreover, to enhance the performance or stability of the water-soluble capsule, it may contain ingredients besides the above-described water-soluble material. Examples of additional ingredients include, but are not limited to, brighteners, builders, activators, enzymes, and the like.

Depending on the intended use and desired performance, the water-soluble capsule can be in any shape or thickness. For example, the capsule can be in a shape of round, oval, rectangular, square, triangle, diamond, or a combination thereof. By "thickness," it is meant to be the length from the inner surface of the capsule to the outer surface of the capsule. In one specific embodiment, the thickness of the capsule is from about 0.5 to about 10 mils. Preferably, the capsule is in the form of a rounded film. The capsule can be transparent, semi-transparent, or opaque. The capsule may also be of any color.

In one embodiment, the present invention includes a container containing one or more capsules as described above.

In another embodiment, the present invention provides a container, such as, e.g., a metered dose container, comprising the present cleaning composition directly. The container may be in any shape or size depending on the intended use and other functional consideration. For example, the container may be in a shape that is space-saving for storage or transportation purpose, or in a shape that can be easily held/grabbed by a consumer for convenience of use, or both.

In one embodiment, the container has an opening and is in such a shape that consumer's hand can easily reach in and take any of the capsules inside the container. In another embodiment, the container is in a shape to serve as a dispenser, and thereby the consumer's hand can easily reach in and take any of the capsules inside the container. In another embodiment, the container is in a shape to serve as a dispenser, and thereby the consumer's hand does not need to reach inside the container for distributing the capsules. In another embodiment of the present invention, the container is in a shape which allows stacking. In one embodiment of the present invention, the container comprises a chamber for each capsule.

In another embodiment, the container comprises as hand pump dispenser for dispensing the aforementioned metered doses. While larger metered doses are provided in some embodiments, preferred metered dose sizes are less than about 5 ml (where "about X ml" means X±0.25 ml), more preferably between about 2 and about 4 ml. In one approach, the cleaning composition is added to a volume of external water by pumping a hand pump dispenser no more than 8 times, where the hand pump dispenser dispenses about 4 ml (maximum) or less per pump. In particularly preferred approaches, the hand pump dispenser is pumped no more than 6 times, where the hand pump dispenser dispenses about 3 ml or less per pump. The volume of external water in these approaches is 69 liters, which is the standard water volume used in a washload in a standard washing machine. Those skilled in the art will appreciate that the numbers of pumps can be adjusted based on the volume of cleaning composition dispensed per pump and/or for washloads having higher or lower external water volumes. As a general guideline, in particularly preferred approaches, less than about 0.32 grams of the cleaning composition is dissolved per liter of external water, and more preferably less than about 0.26 grams of the cleaning composition is dissolved per liter of external water.

Such low dosing is permitted by the surprising low in-use concentration requirements enabled by the present cleaning composition, as well as the surprisingly low viscosity. This is a great improvement over previous attempts to provide pump-dispensable detergents, which required pumping of significantly larger quantities of detergent. Such prior art attempts generally used a "condiment type" dispenser on a very large reservoir, making the container overly-tall, heavy when full), and generally difficult to handle. Thus, embodiments of the present invention fill a heretofore unmet need in the marketplace for a cleaning composition that is effective at low dosages and has a low viscosity, thereby permitting cost-effective manufacture and use of the present cleaning composition in a hand pump dispenser that is small enough to be easily handled and used by a consumer.

In one illustrative embodiment, the volume of the container is less than about 1 liter, preferably less than about 0.75 liters. In one approach, the hand pump dispenser has an average circumference of a sidewall extending along its longitudinal axis of less than about 12 inches, more preferably less than about 10 inches, even more preferably less than about 8 inches. This smaller circumference allows the Container to be gripped by one hand and the pump operated with the same hand.

A further benefit enabled by the pumpability of the present cleaning composition is the ability to easily target stains during pretreatment. For example, the cleaning composition may be applied directly and accurately to the immediate vicinity of the stain in a more controlled manner than was previously available, i.e., via pouring out of a bottle or cap. Moreover, there is less chance for creating a mess due to spills, overpours, etc.

In another embodiment, the container may comprise multiple chambers wherein at least one of the chambers contain the present cleaning composition, and at least one of the chambers are empty. For example, the container may be a bottle having dual chambers where a consumer may put water in the empty chamber and then mix the water with some or all of the cleaning composition in another chamber for the purpose of diluting the cleaning composition in situ.

The container may be made of any material depending on the intended use and other functional consideration. Examples of suitable material include, but are not limited to glass, plastic, wood, metal, alloy, fabric, porcelain, clay, polymer, and combinations thereof. Preferably, the container is made of a recyclable material. The container may also be in any form suitable for consumer products. Examples of the suitable form include, but are not limited to bottle, canister, pouch, box, etc. The container may comprise an opening with a lid, zip, or other means to open and close the opening as needed. The lid may optionally be a hinged lid, such as a flip-top. The container may optionally comprise a handle.

In one embodiment, the container includes a label, printing, etc. with directions to follow one or more of the methods set forth herein.

In one embodiment, the present invention provides a method for cleaning a non-textile surface. The method comprises dissolving the present cleaning composition in a volume of water to form a diluted aqueous cleaning composition; and applying the diluted aqueous cleaning composition to a non-textile surface to clean the surface. The cleaning composition may be dissolved by adding the present cleaning composition directly into a volume of water, by adding a water-soluble capsule containing the present cleaning composition into a volume of water, etc. The amount of the cleaning composition may be predetermined. Depending on the condition of a non-textile surface, the non-textile surface may be pre-treated by directly applying the cleaning composition to the non-textile surface.

In one embodiment, the present invention provides a method comprising directly applying a first amount of the cleaning, composition to a non-textile surface; dissolving a second amount of the present cleaning composition in a volume of water to form a diluted aqueous cleaning composition; and applying the diluted aqueous cleaning composition in a volume of water to fibrin a diluted aqueous cleaning composition; and applying the diluted aqueous cleaning composition to the non-textile surface to clean the surface.

In another embodiment of a method for cleaning a non-textile surface, the method comprises applying an amount of the cleaning composition to a non-textile surface; and washing the non-textile surface with water. This method allows a consumer to clean the non-textile surface manually. For example, a consumer may spray or otherwise apply the present cleaning composition directly to the surface of a plate or other non-textile surface, rub the surface with hands or scrub it with a brush or a wiping piece, and then wash the surface with water. In another approach, the cleaning composition may be applied to the non-textile surface as a pretreatment, with or without wiping or scrubbing. The non-textile surface is then later rinsed with water.

In one embodiment, the present invention provides a method for cleaning laundry. The method comprises dissolving the present cleaning composition in is volume of water to form a diluted aqueous cleaning composition; and contacting the diluted aqueous cleaning composition with the laundry to clean the same. The cleaning composition may be dissolved by adding the present cleaning composition directly into a volume of water, by adding a water-soluble capsule containing the present cleaning composition into a volume of water, by adding the present cleaning composition into a detergent receptacle of a washing machine, etc. Moreover, the laundry may or may not be in the water prior to addition of the cleaning composition to the water. The amount of the cleaning composition may be predetermined. Depending on the condition of laundry, the laundry may be pre-treated by directly applying the cleaning composition to the laundry. In one embodiment, the present invention provides a method comprising directly applying a first amount of the cleaning composition to the laundry; dissolving a second amount of the present cleaning composition in a volume of water to form a diluted aqueous cleaning composition; and applying the diluted aqueous cleaning composition to the laundry to clean the same.

EXAMPLES

This section sets forth several illustrative embodiments, along with representative test results. Unless otherwise specified, data was derived using the testing procedures set forth in ASTM D4265.

Tables 2 and 3 below list the ingredients of two exemplary cleaning compositions of the present invention.

TABLE 2

| Cleaning Composition B* | |
|---|---|
| Ingredients | Wt. Percentage |
| LAE 91-6 | 31.00 |
| LAE 25-3 | 4.00 |
| water | 25.70 |
| propylene glycol | 5.00 |
| ethanol 190 proof | 5.00 |
| dipropylene glycol methyl ether | 3.30 |
| Fragrance compound | 0.50 |
| sodium dodecylbenzene sulfonate | 18.00 |
| protease liquid | 2.40 |
| amylase liquid | 1.60 |
| 2000 mw sodium polyacrylate 40% | 1.50 |
| sodium borate | 2.00 |

TABLE 3

| Cleaning Composition C* | |
|---|---|
| Ingredients | Wt. Percentage |
| LAE25-7 | 31.18 |
| coco methyl ester 6 EO | 8.00 |
| LAE 25-3 | 4.00 |
| water | 0.00 |
| tripropylene glycol | 5.00 |
| ethanol 190 proof | 5.00 |
| 1,3 propanediol | 3.30 |
| Fragrance compound | 1.50 |
| secondary alkane sulfonate 60% | 34.00 |
| protease liquid | 5.00 |

TABLE 3-continued

| Cleaning Composition C* | |
|---|---|
| Ingredients | Wt. Percentage |
| amylase liquid | 2.00 |
| 3000 mw polyaspartate | 0.50 |
| stilbene type optical brightener | 0.02 |
| 4-formyl phenyl boronic acid | 0.50 |

Depending on the water content in various ingredients, the total water concentration in the cleaning composition may be from about 10% to about 40% although most of the water content is not free water.

Figure 2:
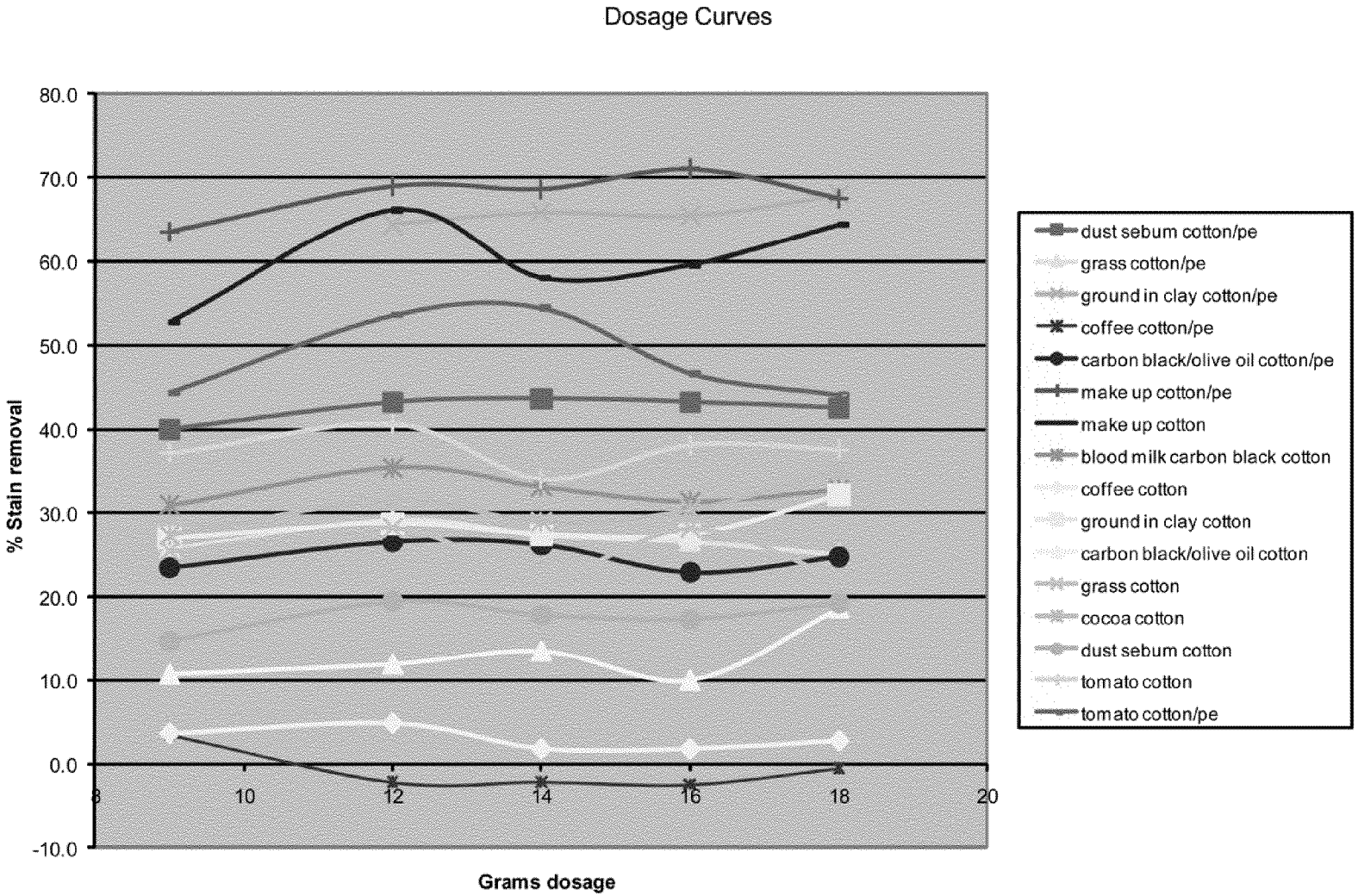
FIG. 2 is a chart showing the stain removal performance of a cleaning composition according to one embodiment across a variety of dosage amounts for a variety of soils.

FIG. 2 shows the stain removal performance of Composition D listed in Table 4, below, across a variety of dosage amounts for a variety of soils. Note that FIG. 2 includes the data used in FIG. 1 and some additional data. To generate the data, test method ASTM D4265 was followed for each dosing amount of Composition D having a data point on the graph of FIG. 2.

Figure 3:
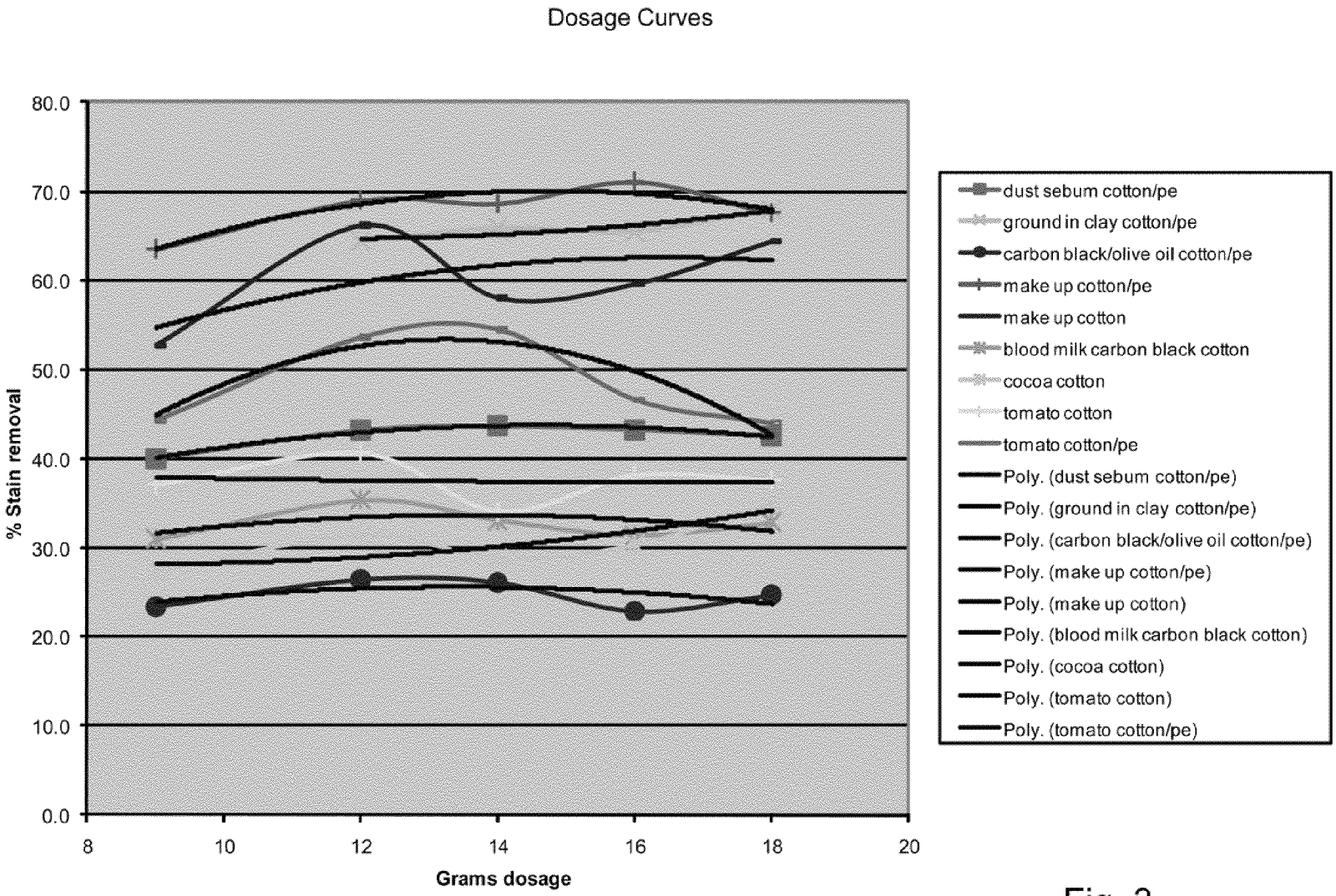
FIG. 3 is a chart showing trend lines applied to some of the data from FIG. 1.

FIG. 3 shows trend lines applied to some of the data from FIG. 1.

TABLE 4

| Cleaning Composition D | |
|---|---|
| Ingredients | Wt. Percentage |
| Water | 10 |
| LAE 24-7 Alcohol Ethoxylate (Genapol LA 070S) | 31 |
| Ethanol 190 proof SDA-40B | 0.5 |
| Dipropylene Glycol Methyl Ether | 4 |
| LAE 24-3 Alcohol Ethoxylate (Genapol LA 030) | 1.6 |
| 1,3 propanediol | 1.5 |
| Glycerin 99% | 6 |
| Fragrance compound | 0.4 |
| C12-16 coco methyl ester sulfonate (AlphaStep MC-48) | 17.5 |
| secondary alkane sulfonate (Hostapur SAS 60 LS) | 15.5 |
| coco methyl ester ethoxylate (Surfonic ME 400 CO) | 7 |
| Palm methylester ethoxylate (Surfonic ME 530 PS) | 0.5 |
| antiredeposition agent (Texcare SRN 240) | 0.3 |
| Protease Enzyme (Purafect Prime, sold by Brenntag NV · Nijverheidslaan 38 · BE-8540 Deerlijk, Belgium)) | 3 |
| Amylase Enzyme (Purastar ST 15000L, sold by Brenntag NV · Nijverheidslaan 38 · BE-8540 Deerlijk, Belgium) | 1.2 |
| TOTAL | 100.0 |

Figure 4:
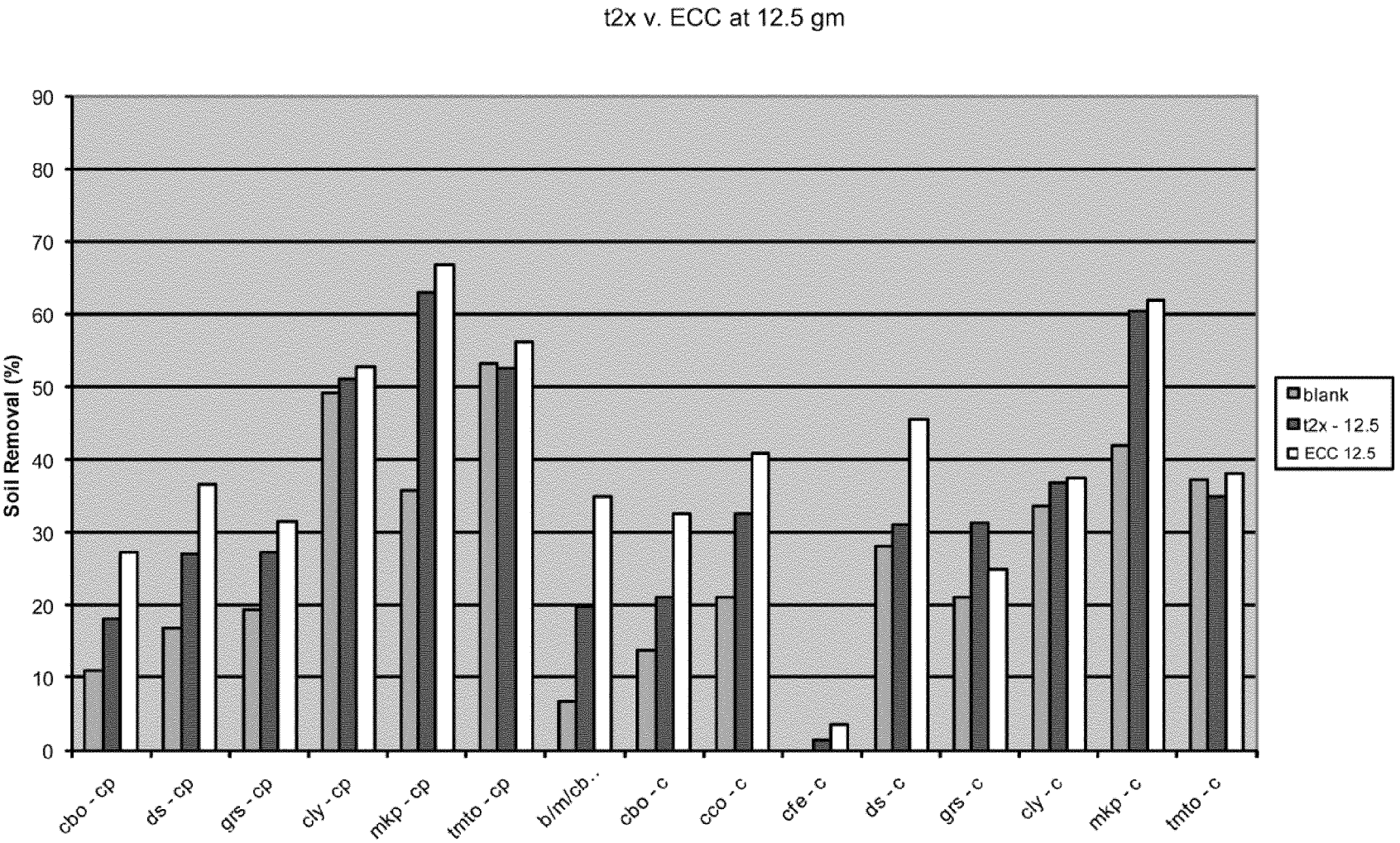
FIG. 4 is a chart showing a comparative example of cleaning efficacy of a cleaning composition according to one embodiment and TIDE 2X for a variety of soils.

FIG. 4 illustrates a comparative example of the cleaning efficacy of a formulation of an experimental cleaning composition (ECC, hereinafter referred to as the "experimental cleaning composition") based on Composition A vs. TIDE 2X (t2x) concentrated liquid detergent. The "blank" data was obtained from a run without any detergent. Each composition was used at a dose of 12.5 grams per 69 liters of water and the aforementioned test method was used. The key for the X-axis referrents is shown in Table 5.

TABLE 5

| Key for abbreviations in FIGS. 4-8 | | |
|---|---|---|
| carbon black in olive oil | cotton-poly | cbo-cp |
| dust sebum | cotton-poly | ds-cp |
| grass | cotton-poly | grs-cp |
| ground-in clay | cotton-poly | cly-cp |
| makeup | cotton-poly | mkp-cp |
| tomato | cotton-poly | tmto-cp |
| blood/milk/carbon black | cotton | b/m/cb-c |
| carbon black in olive oil | cotton | cbo-c |

TABLE 5-continued

| Key for abbreviations in FIGS. 4-8 | | |
|---|---|---|
| cocoa | cotton | cco-c |
| coffee | cotton | cfe-c |
| dust sebum | cotton | ds-c |
| grass | cotton | grs-c |
| ground-in clay | cotton | cly-c |
| makeup | cotton | mkp-c |
| tomato | cotton | tmto-c |

As shown in FIG. 4, the cleaning composition (LH) outperformed TIDE 2X in nearly every test.

Figure 5:
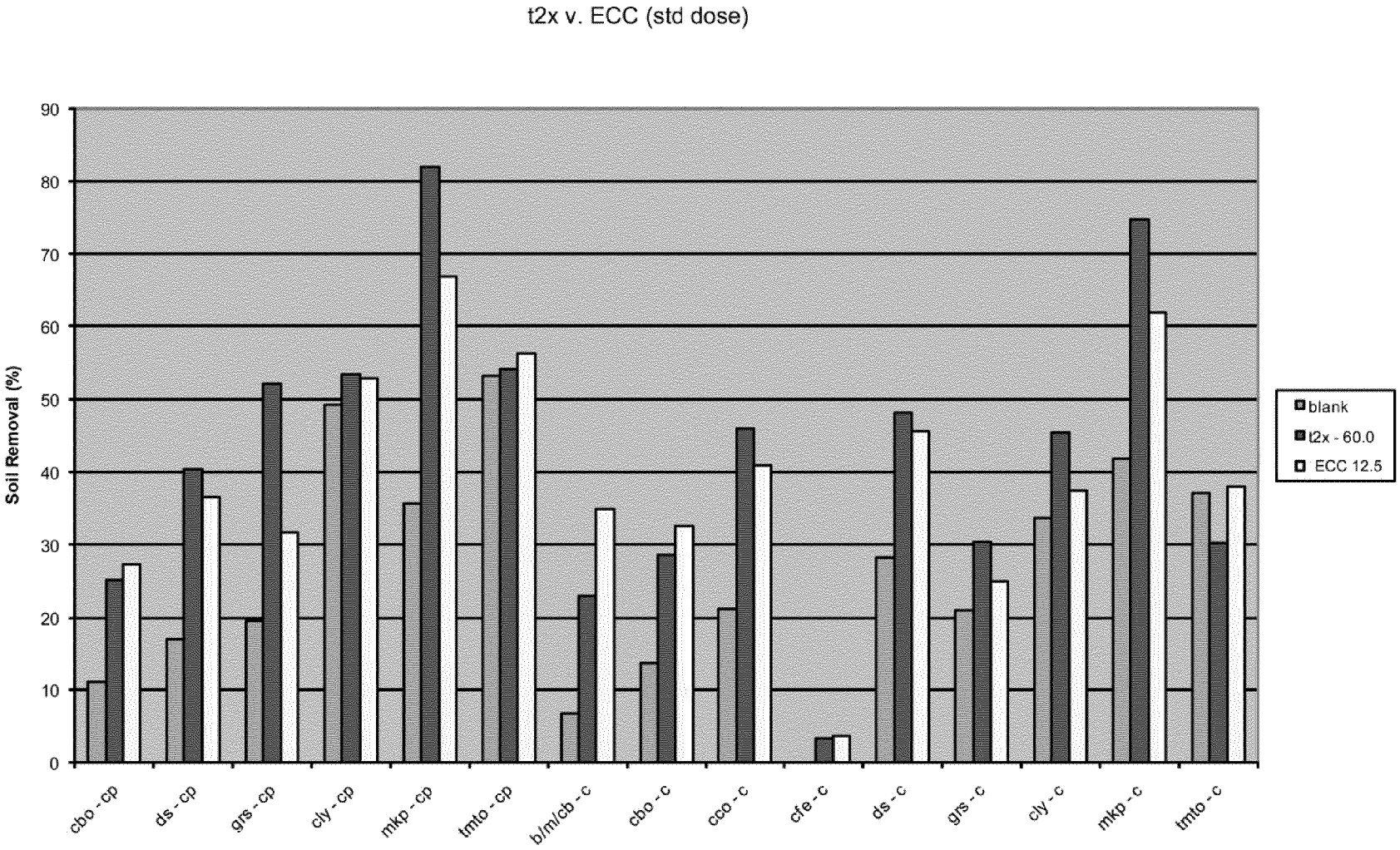
FIG. 5 is a chart showing a comparative example in which 12.5 grams of an experimental cleaning composition according to one embodiment was used but 60 grams of the TIDE 2X was used.

Referring to FIG. 5, there is shown a comparative example in which 12.5 grams of the experimental cleaning composition was used, but 60 grams of the TIDE 2X was used. These is the "standard dose" fibs each composition to clean an average size load of laundry in a standard washing machine. As shown in FIG. 5, the cleaning efficacy of the cleaning composition is similar to that of TIDE 2X, and even superior in many cases, even though a much smaller amount of the detergent was added to the washing machine.

Figure 6:
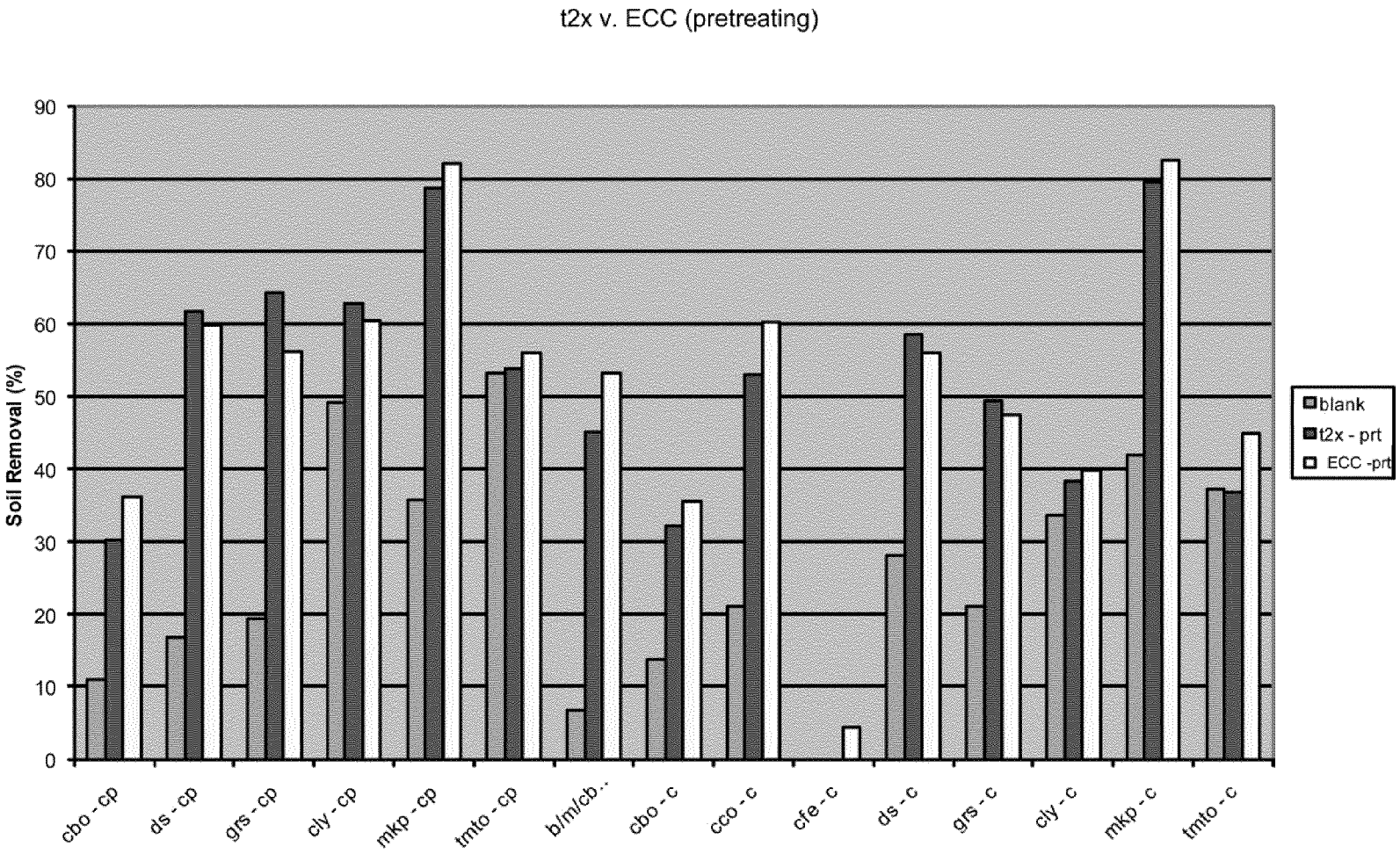
FIG. 6 is a chart of results of pretreatment using the experimental cleaning composition according to one embodiment and pretreatment using TIDE 2X.

FIG. 6 shows a chart of results of pretreatment using the experimental cleaning composition and pretreatment using TIDE 2X. In this experiment, 3 drops of each of the detergents were each added to a respective stain and allowed to soak into the fabric. Then the foregoing cleaning procedure was used to wash the fabrics, using the standard dose. This modified ASTM D4265 test emulates typical household pretreatment behavior. As shown in FIG. 6, the cleaning efficacy of the cleaning composition was similar, and in many cases superior, to that of TIDE 2X.

Figure 7:
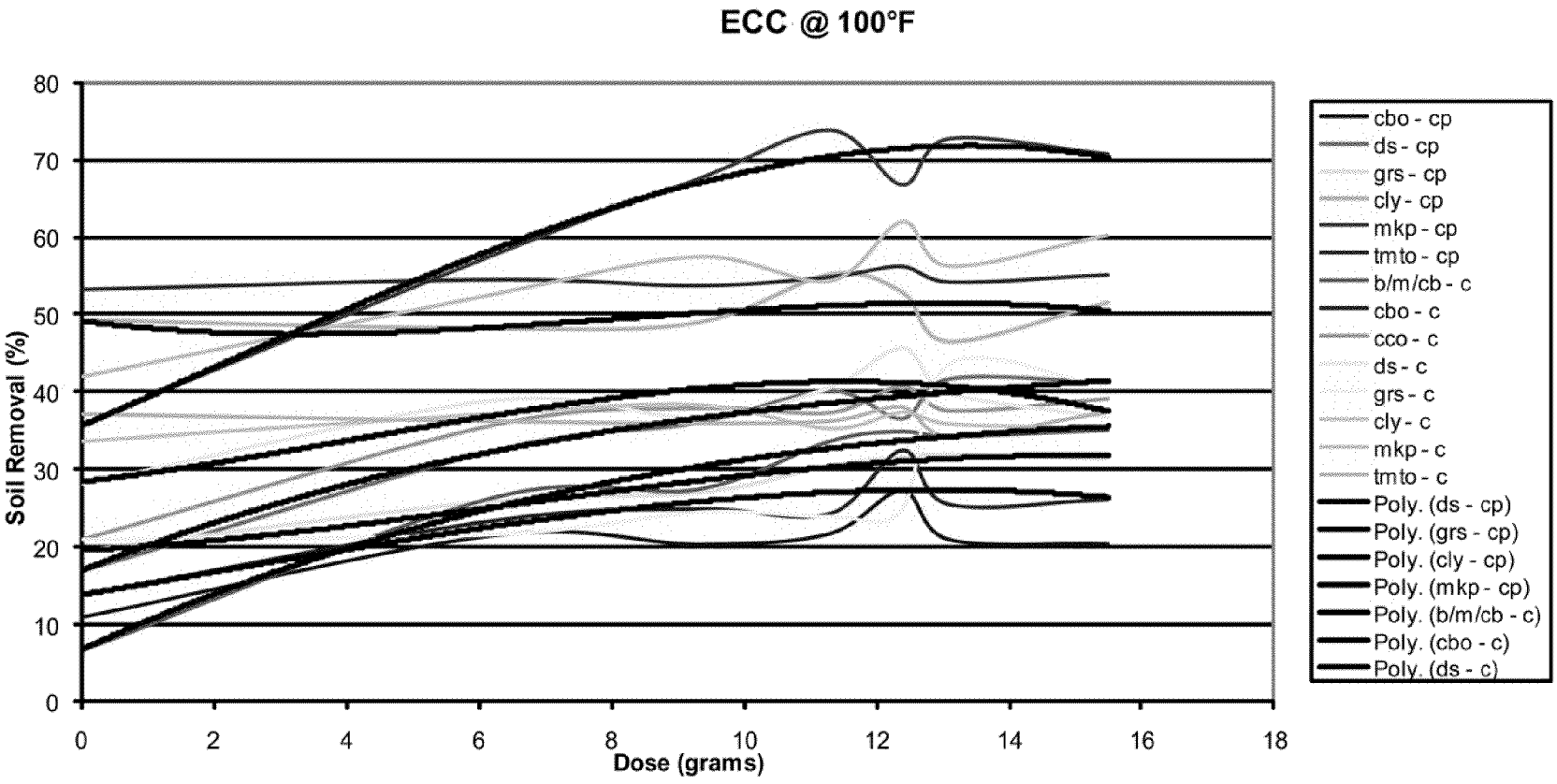
FIG. 7 is a chart showing the relatively nonlinear relationship between dosage and cleaning efficacy for the experimental cleaning composition according to one embodiment.
Figure 8:
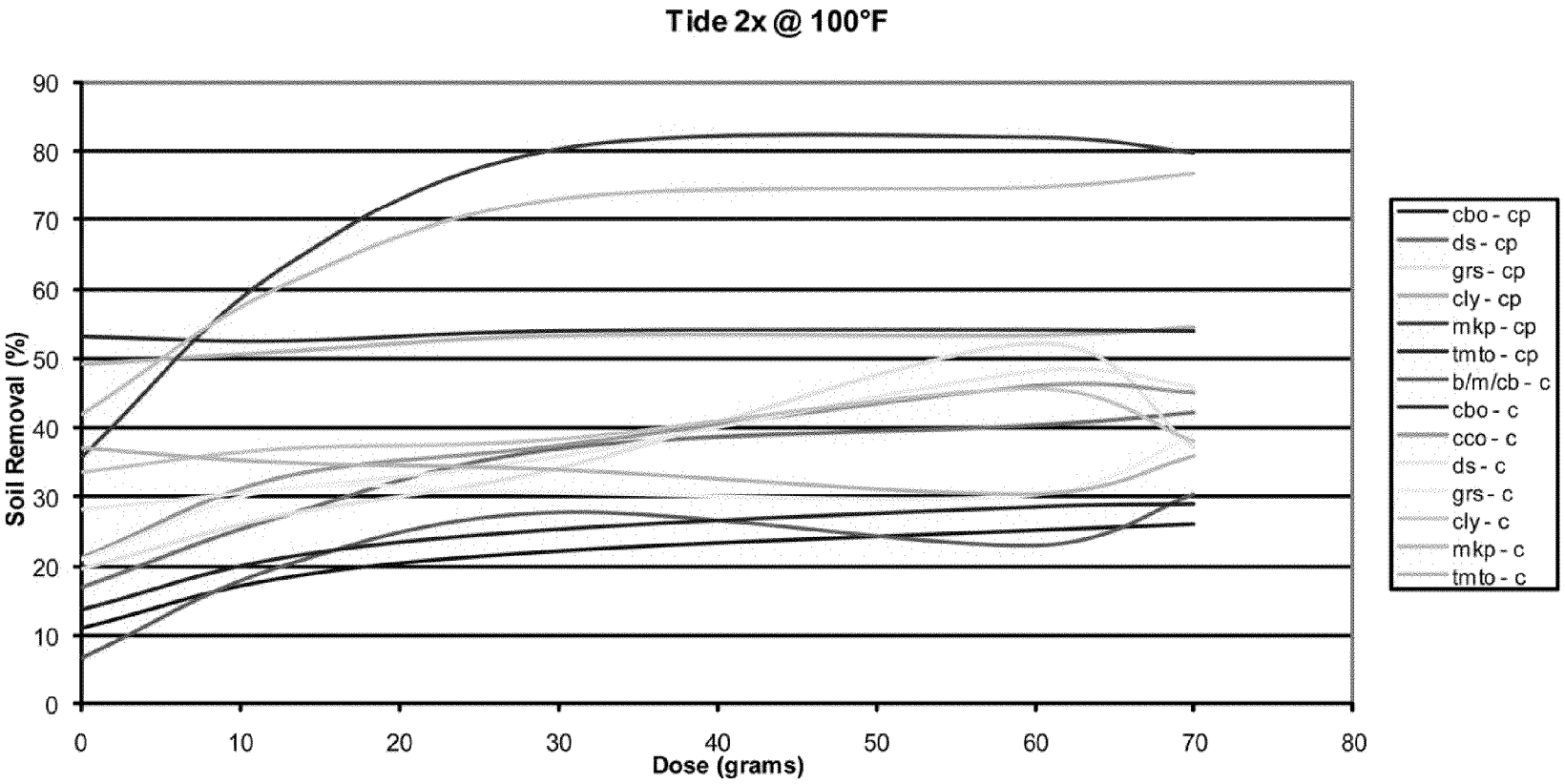
FIG. 8 is a chart showing the relationship between dosage and cleaning efficacy for TIDE 2X under identical conditions as used to generate the data in FIG. 7.

FIG. 7 shows the relatively nonlinear relationship between dosage and cleaning efficacy for the experimental cleaning composition when used according to the aforementioned test procedure at 100° F. As a comparative example, FIG. 8 shows the relationship between dosage and cleaning efficacy for TIDE 2X under identical conditions. Note that, in the significantly smaller dosage range shown in the x-axis of FIG. 7 (0 to about 15 grams), the cleaning efficacy of TIDE 2X exhibits a relatively linear relationship between dosage and cleaning efficacy.

FIGS. 9-15 are graphs illustrating the comparative cleaning efficacy vs. temperature under identical conditions for the experimental cleaning composition and TIDE 2X for various soils on cotton and/or a 60/40 cotton/polyester blend, using the pretreatment scheme detailed for FIG. 6, across various external water temperatures. As shown, the experimental cleaning composition provides comparable cleaning efficacy as the TIDE 2X, and in most cases, a better cleaning efficacy at lower temperatures.

Figure 9:
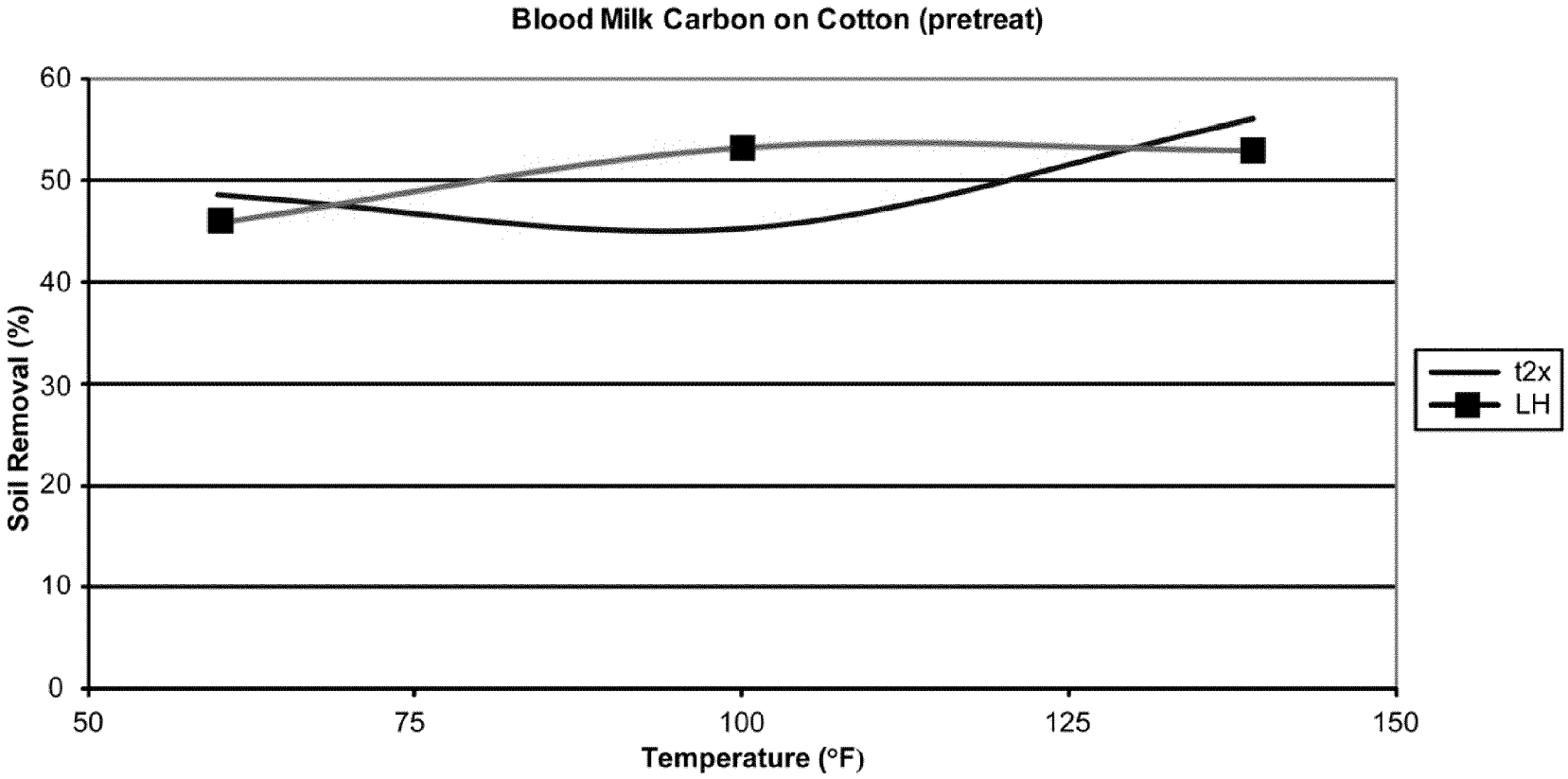
FIG. 9 is a graph depicting the comparative cleaning efficacy vs. temperature under identical conditions tot the experimental cleaning composition according to one embodiment and TIDE 2X for blood, milk and carbon on cotton, with pretreatment.

FIG. 9 is a graph depicting the comparative cleaning efficacy vs. temperature under identical conditions for the experimental cleaning composition and TIDE 2X for blood, milk and carbon on cotton, with pretreatment.

Figure 10:
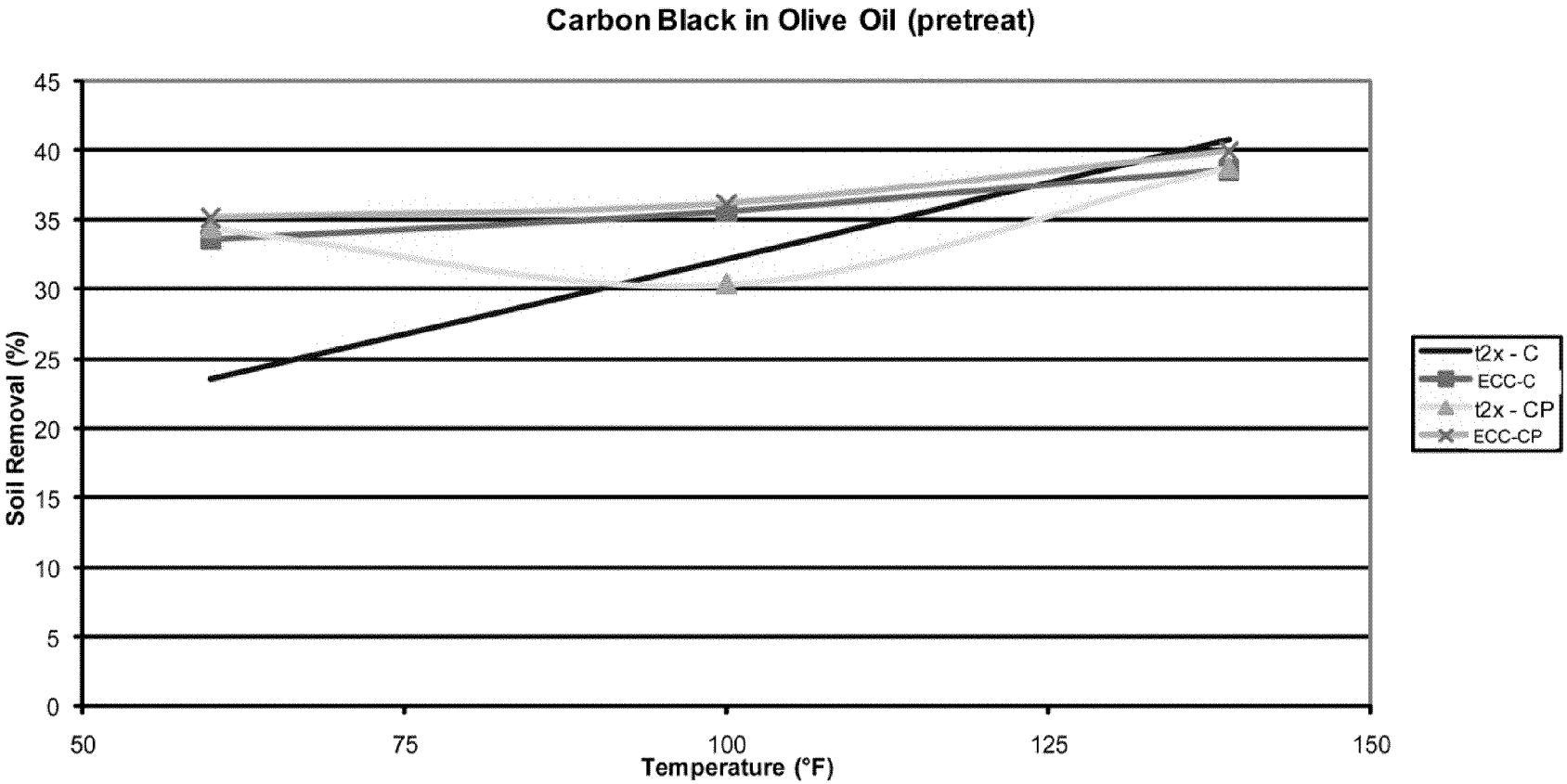
FIG. 10 is a graph depicting the comparative cleaning efficacy vs. temperature under identical conditions for the experimental cleaning composition according to one embodiment and TIDE 2X for carbon black in olive oil on both cotton (denoted by -C in legend) and cotton-polyester textiles (denoted by -CP in legend) with pretreatment.

FIG. 10 is a graph depicting the comparative cleaning efficacy vs. temperature under identical conditions for the experimental, cleaning composition and TIDE 2X for carbon black in olive oil on both cotton (denoted by -C in legend) and cotton-polyester textiles (denoted by -CP in legend), with pretreatment.

Figure 11:
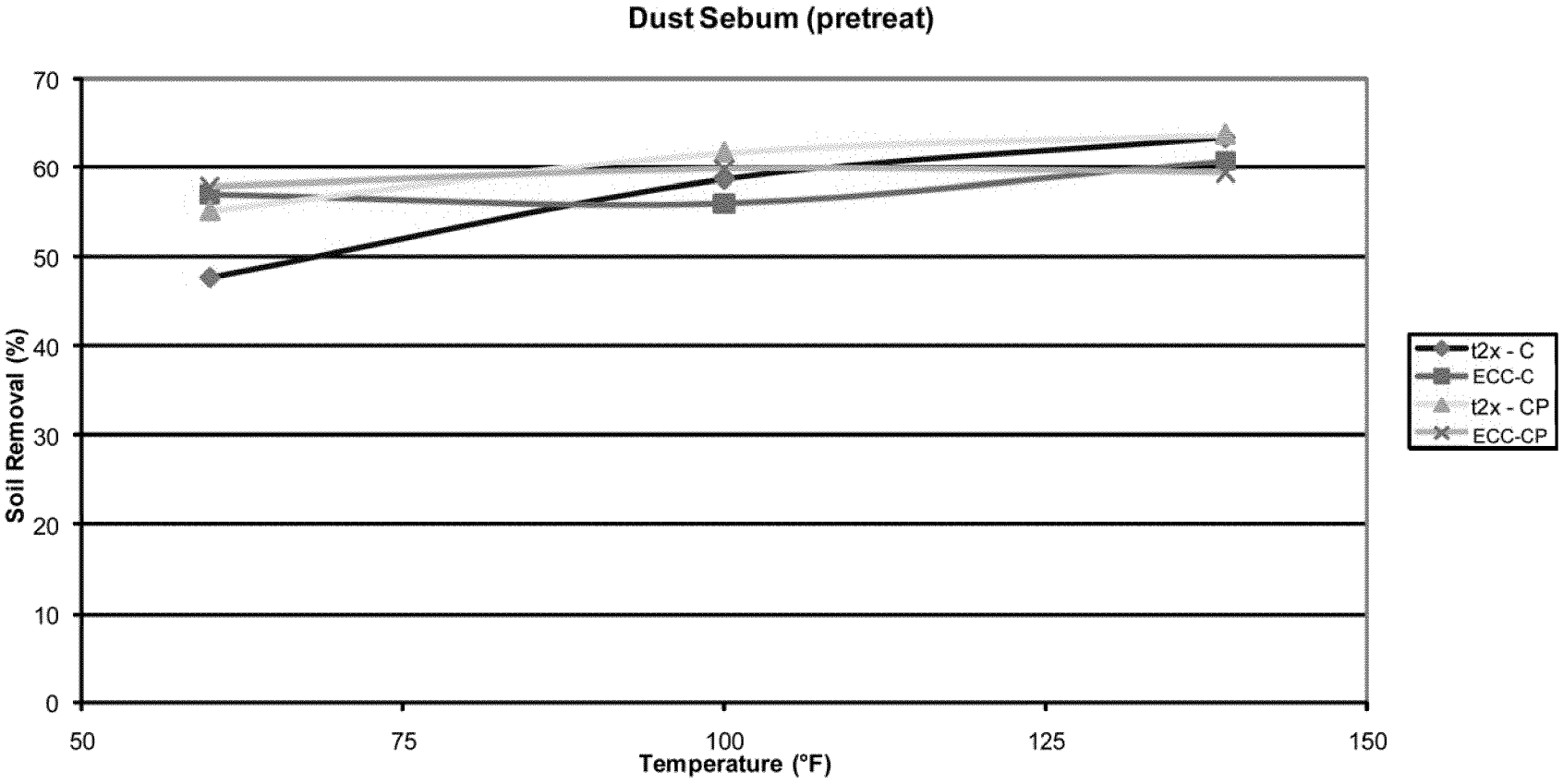
FIG. 11 is a graph depicting the comparative cleaning efficacy vs. temperature under identical conditions for the experimental cleaning composition according to one embodiment and TIDE 2X for dust sebum on both cotton and cotton-polyester textiles, with pretreatment.

FIG. 11 is a graph depicting the comparative cleaning efficacy vs. temperature under identical conditions for the experimental cleaning composition and TIDE 2X for dust sebum on both cotton and cotton-polyester textiles, with pretreatment.

Figure 12:
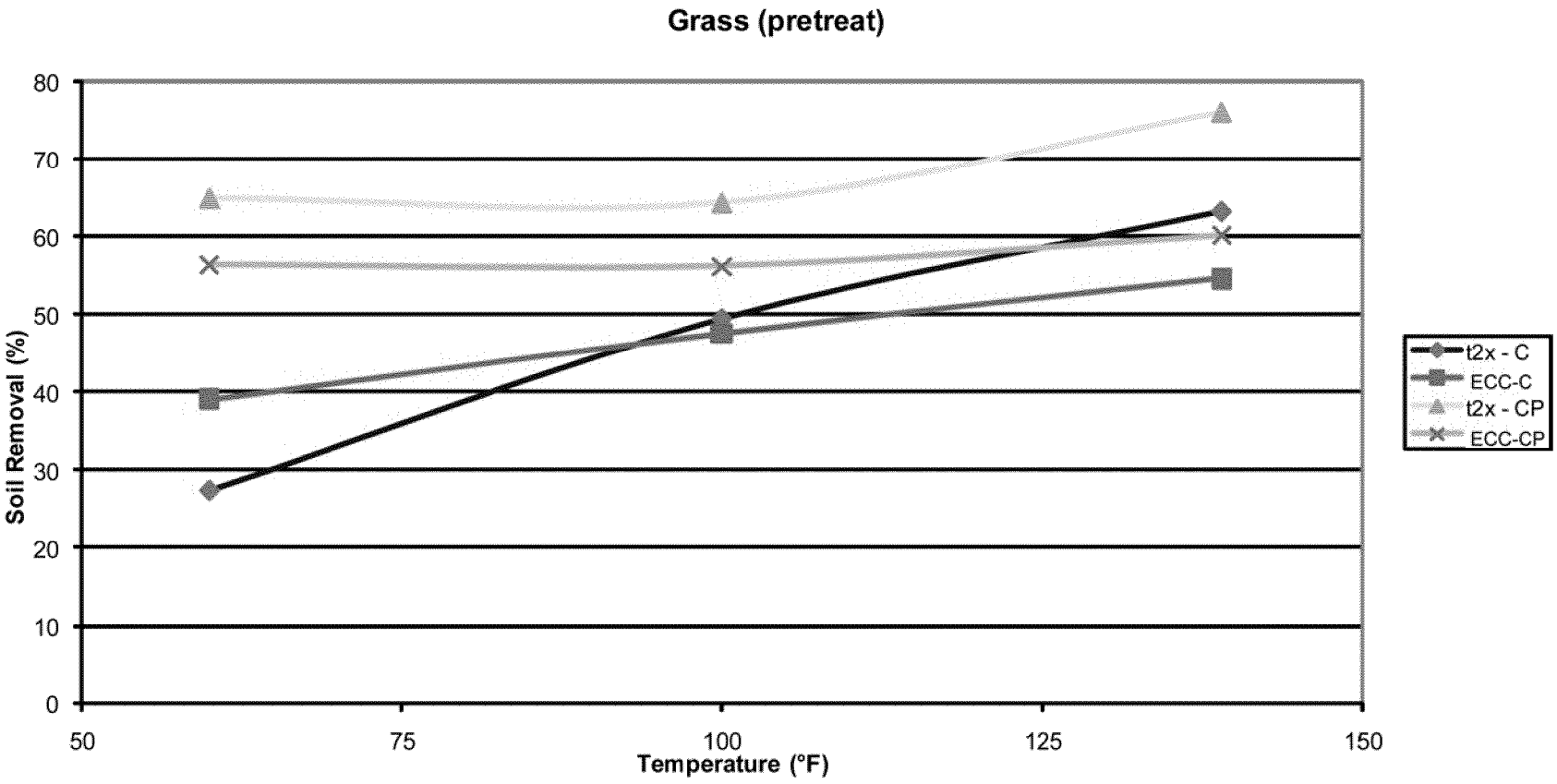
FIG. 12 is a graph depicting the comparative cleaning efficacy vs. temperature under identical conditions for the experimental cleaning composition according to one embodiment and TIDE 2X for grass on both cotton and cotton-polyester textiles, with pretreatment.

FIG. 12 is a graph depicting the comparative cleaning efficacy vs. temperature under identical conditions for the experimental cleaning composition and TIDE 2X for grass on both cotton and cotton-polyester textiles, with pretreatment.

Figure 13:
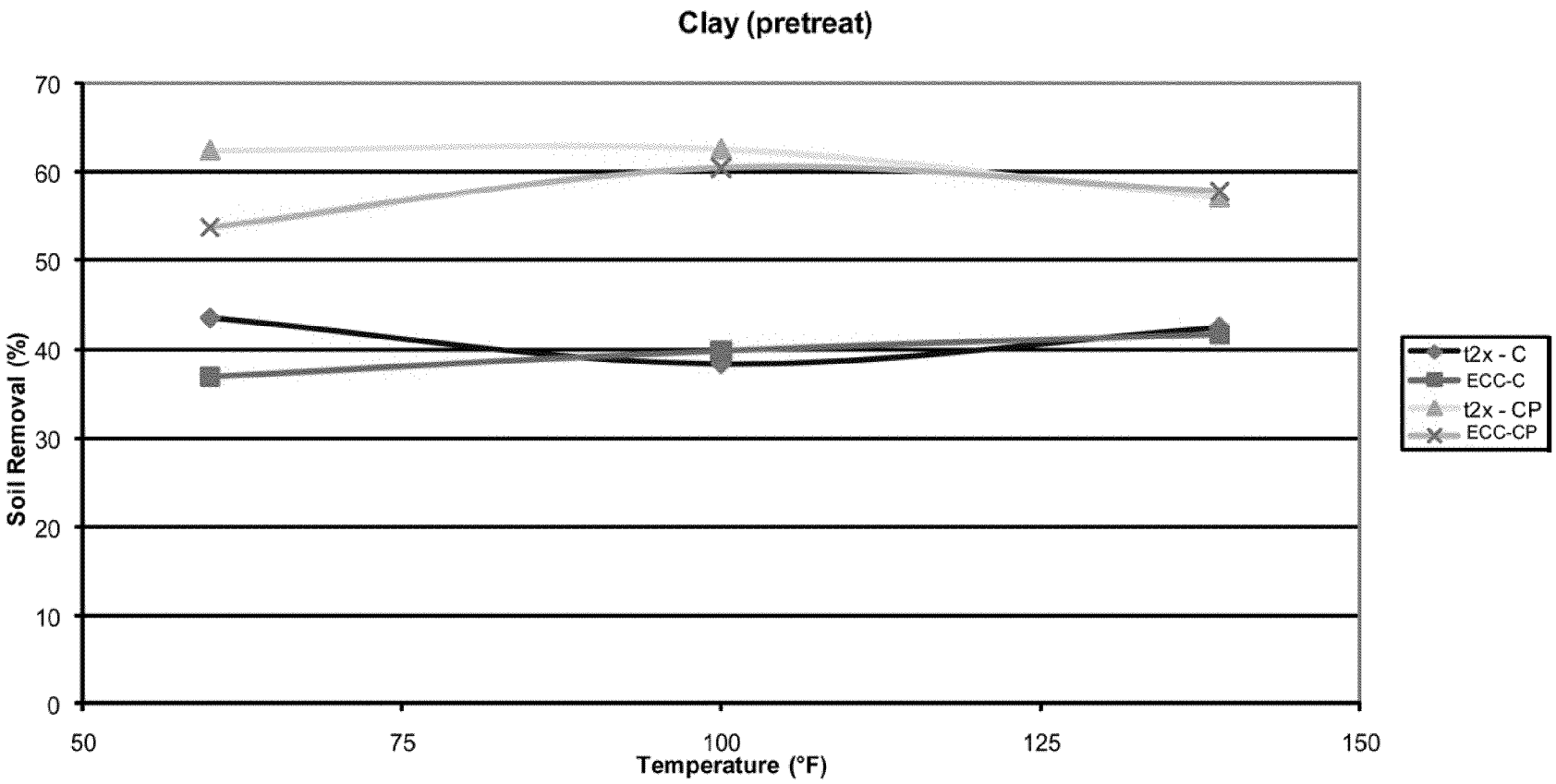
FIG. 13 is a graph depicting the comparative cleaning efficacy vs. temperature under identical conditions for the experimental cleaning composition according to one embodiment and TIDE 2X for clay on both cotton and cotton-polyester textiles, with pretreatment.

FIG. 13 is a graph depicting the comparative cleaning efficacy vs. temperature under identical conditions for the experimental cleaning composition and TIDE 2X for clay on both cotton and cotton-polyester textiles, with pretreatment.

Figure 14:
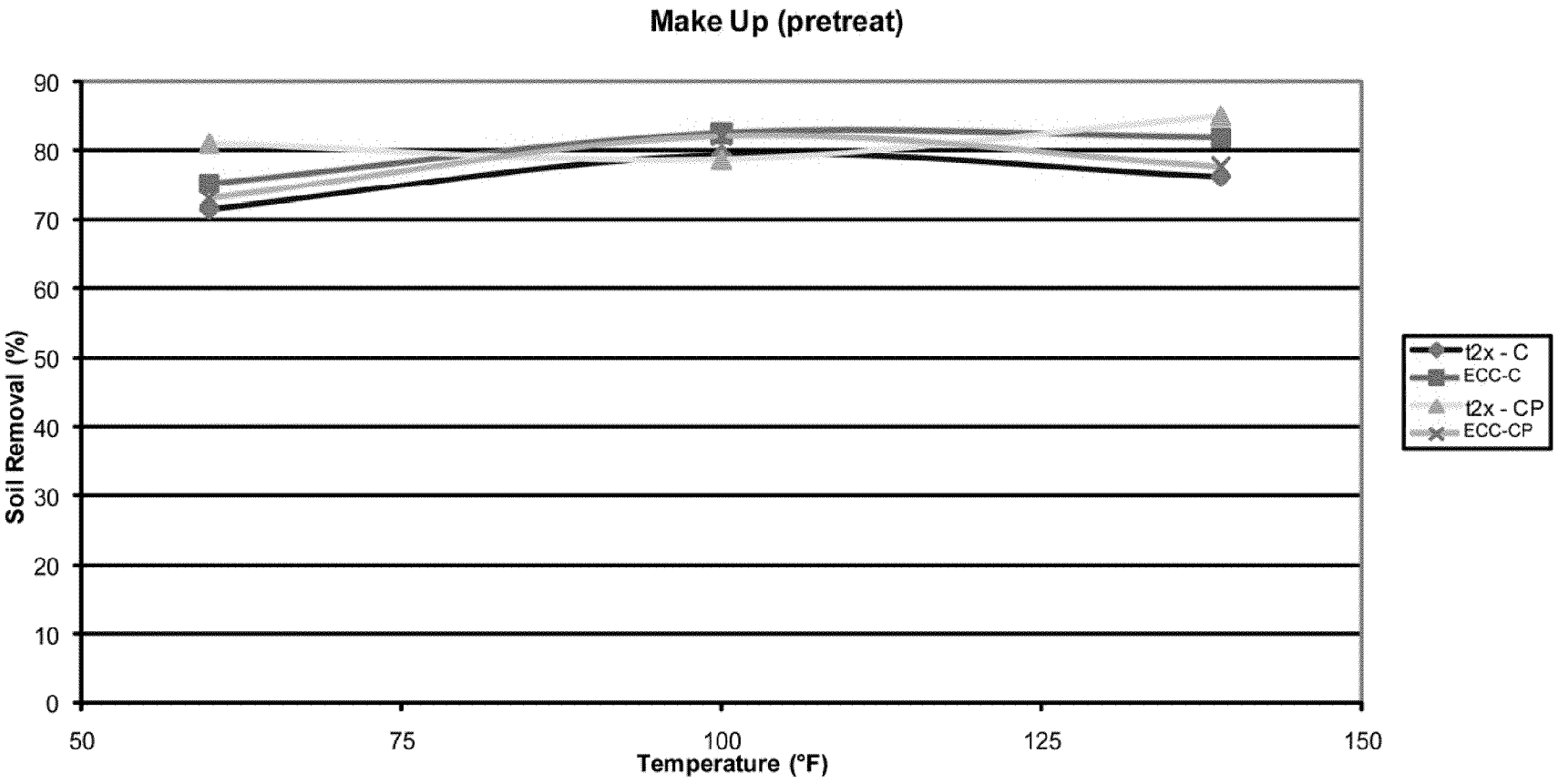
FIG. 14 is a graph depicting the comparative cleaning efficacy vs. temperature under identical conditions for the experimental cleaning composition according to one embodiment and TIDE 2X for make up on both cotton and cotton-polyester textiles, with pretreatment.

FIG. 14 is a graph depicting the comparative cleaning efficacy vs. temperature under identical conditions for the experimental cleaning composition and TIDE 2X for make up on both cotton and cotton-polyester textiles, with pretreatment.

Figure 15:
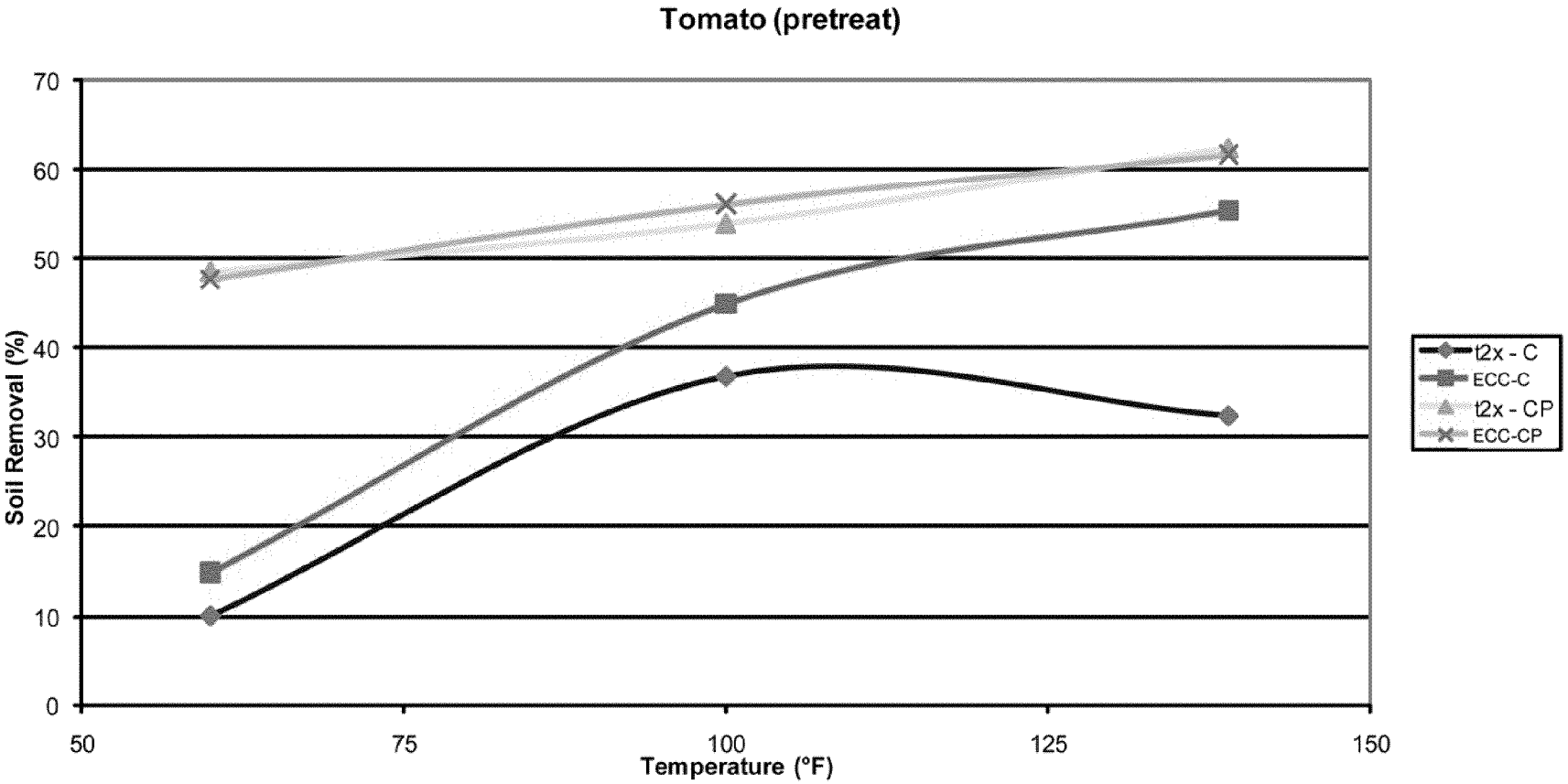
FIG. 15 is a graph depicting the comparative cleaning efficacy vs. temperature under identical conditions for the experimental cleaning composition according to one embodiment and TIDE 2X for tomato on both cotton and cotton-polyester textiles, with pretreatment.

FIG. 15 is a graph depicting the comparative cleaning efficacy vs. temperature under identical conditions for the experimental cleaning composition and TIDE 2X for tomato on both cotton and cotton-polyester textiles, with pretreatment.

FIGS. 16-22 are graphs illustrating the comparative cleaning efficacy vs. temperature under identical conditions for the experimental cleaning composition and TIDE 2X for various soils on cotton and/or a cotton/polyester blend using a standard dose of each detergent, i.e., 12.5 grams of the experimental cleaning composition per 69 liters of water and 60 grams of TIDE 2X per 69 liters of water, across various external water temperatures. As shown, the experimental cleaning composition provides comparable cleaning efficacy as the TIDE 2X, and in most cases, a better cleaning efficacy at lower temperatures.

Figure 16:
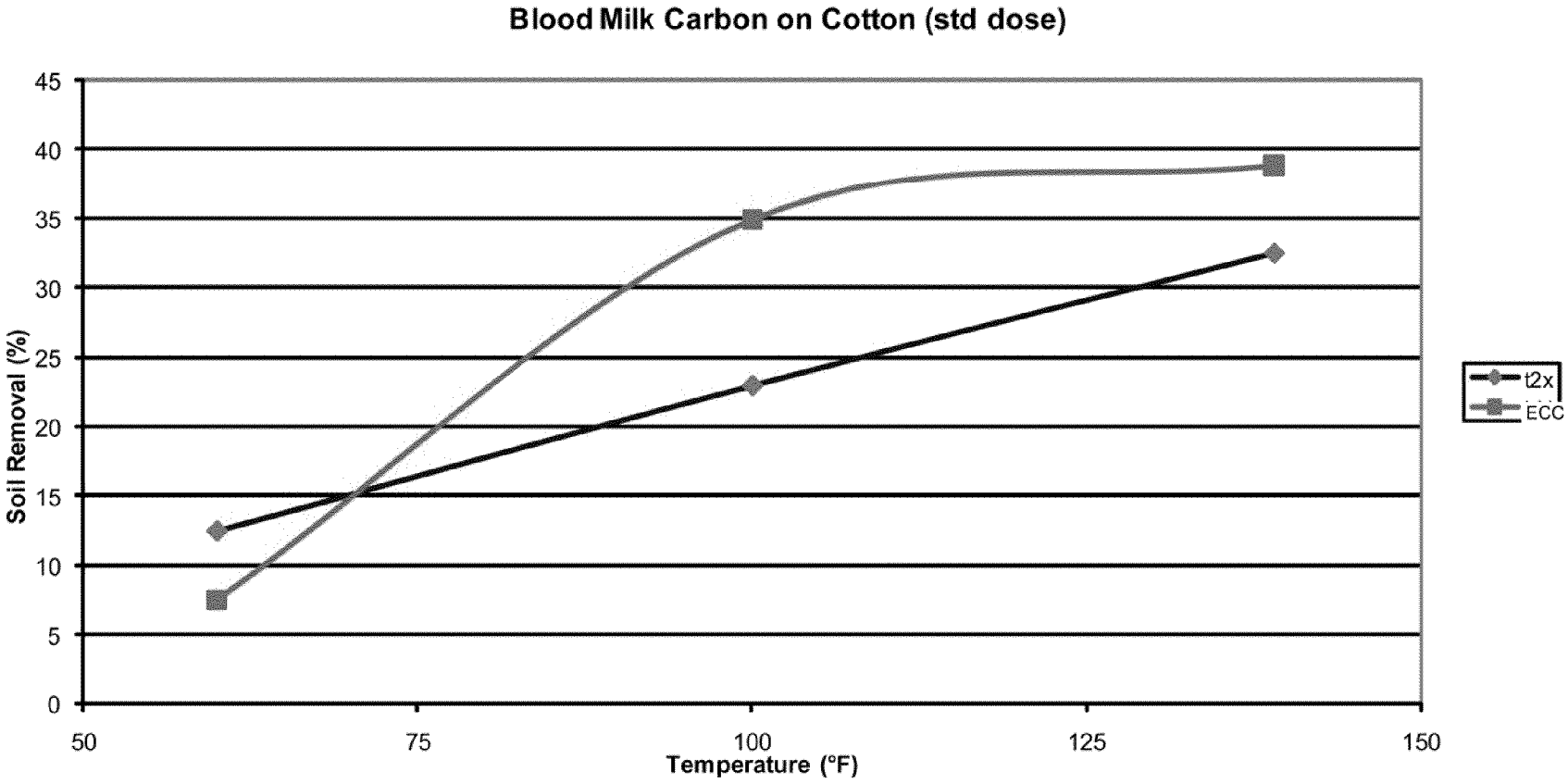
FIG. 16 is a graph depicting the comparative cleaning efficacy vs. temperature under identical conditions for the experimental cleaning composition according to one embodiment and TIDE 2X for blood, milk and carbon on cotton, using a "standard dose" of 12.5 grams of the experimental cleaning composition and 60 grams of TIDE 2X, respectively, per load.
Figure 17:
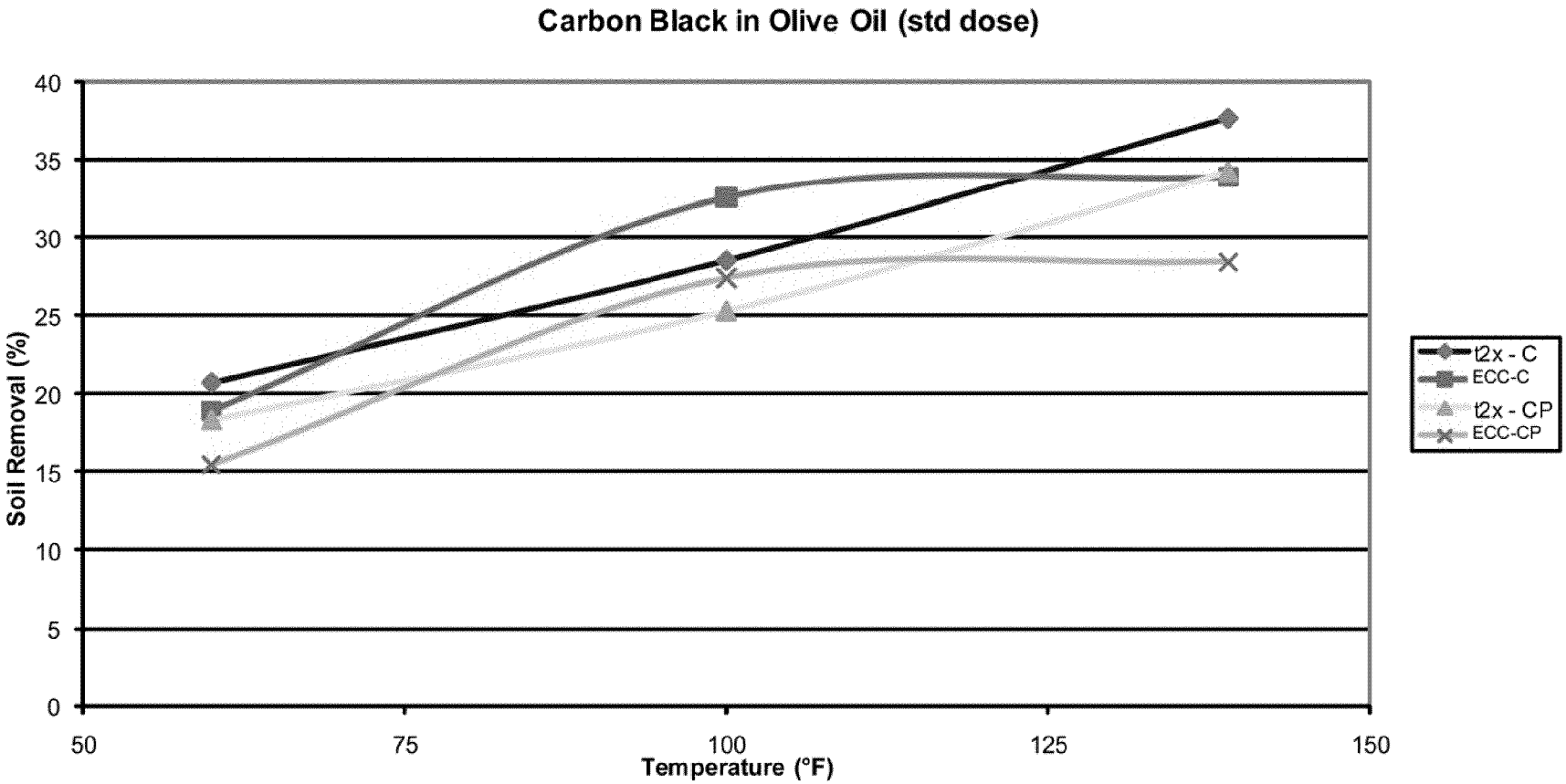
FIG. 17 is a graph depicting the comparative cleaning efficacy vs. temperature under identical conditions for the experimental cleaning composition according to one embodiment and TIDE 2X for carbon black in olive oil on both cotton and cotton-polyester textiles, using 12.5 grams of the experimental cleaning composition a 60 grams of TIDE 2X, respectively, per load.

FIG. 16 is a graph depicting the comparative cleaning efficacy vs. temperature under identical conditions tot the experimental cleaning composition and TIDE 2X for blood, milk and carbon on cotton, using a "standard dose" of 12.5 grams of the experimental cleaning composition and 60 grams of TIDE 2X, respectively, per load.

FIG. 7 is a graph depicting the comparative cleaning efficacy vs. temperature under identical conditions for the experimental cleaning composition and TIDE 2X for carbon black in olive oil on both cotton and cotton-polyester textiles, using 12.5 grams of the experimental cleaning composition and 60 grams of TIDE 2X, respectively, per load.

Figure 18:
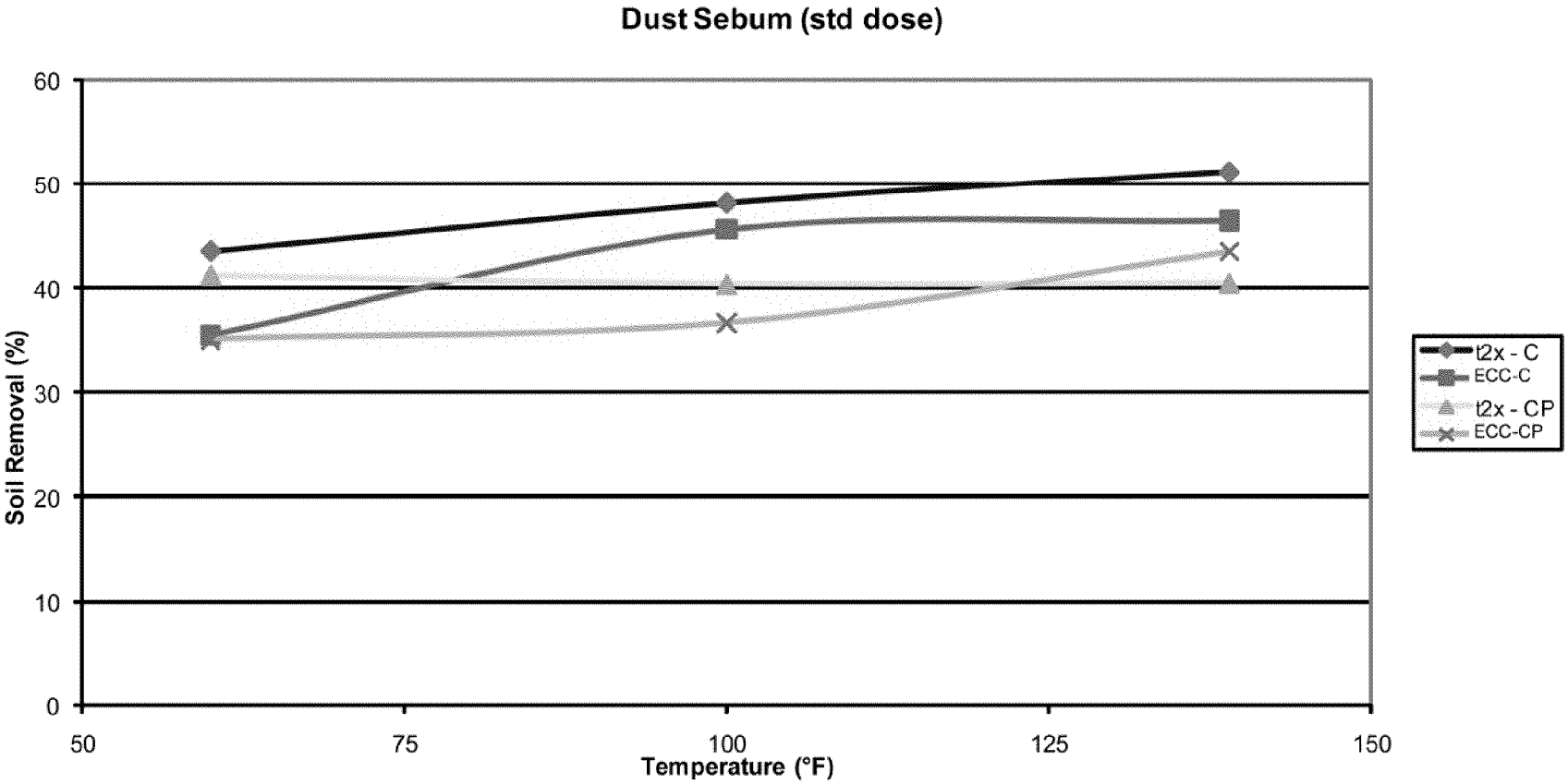
FIG. 18 is a graph depicting the comparative cleaning efficacy vs. temperature under identical conditions for the experimental cleaning composition according to one embodiment and TIDE 2X for dust sebum on both cotton and cotton-polyester textiles, using 12.5 grams of the experimental cleaning composition and 60 grams of TIDE 2X, respectively, per load.

FIG. 18 is a graph depicting the comparative cleaning efficacy vs. temperature under identical conditions for the experimental cleaning composition and TIDE 2X for dust sebum on both cotton and cotton-polyester textiles, using 12.5 grams of the experimental cleaning composition and 60 grams of TIDE 2X respectively, per load.

Figure 19:
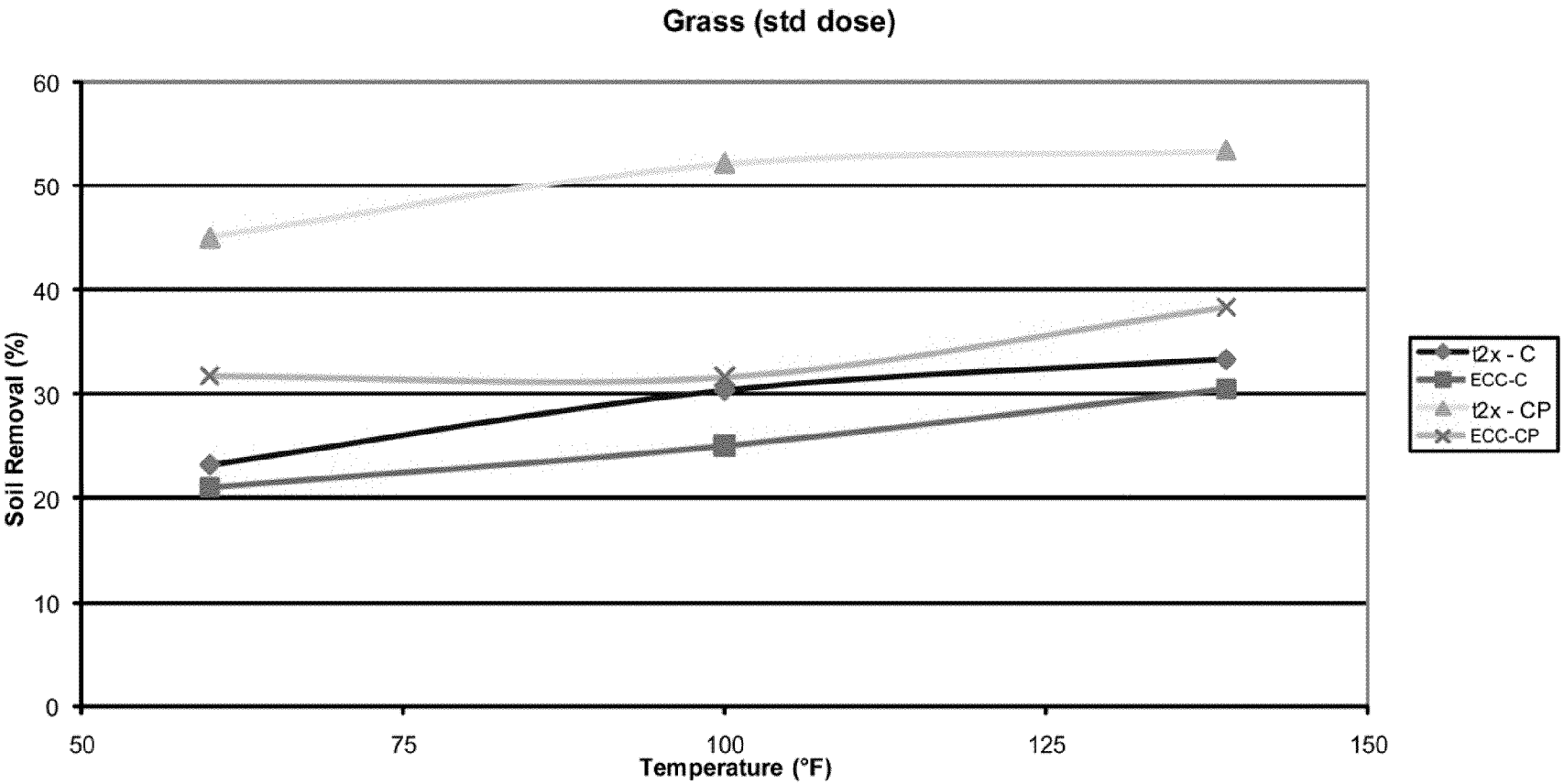
FIG. 19 is a graph depicting the comparative cleaning efficacy vs. temperature under identical conditions for the experimental cleaning composition according to one embodiment and TIDE 2X for grass on both cotton and cotton-polyester textiles, using 12.5 grams of the experimental cleaning composition and 60 grams of TIDE 2X, respectively, per load.

FIG. 19 is a graph depicting the comparative cleaning efficacy vs. temperature under identical conditions for the experimental cleaning, composition and TIDE 2X for grass on both cotton and cotton-polyester textiles, using 12.5 grams of the experimental cleaning composition and 60 grams of TIDE 2X, respectively, per load.

Figure 20:
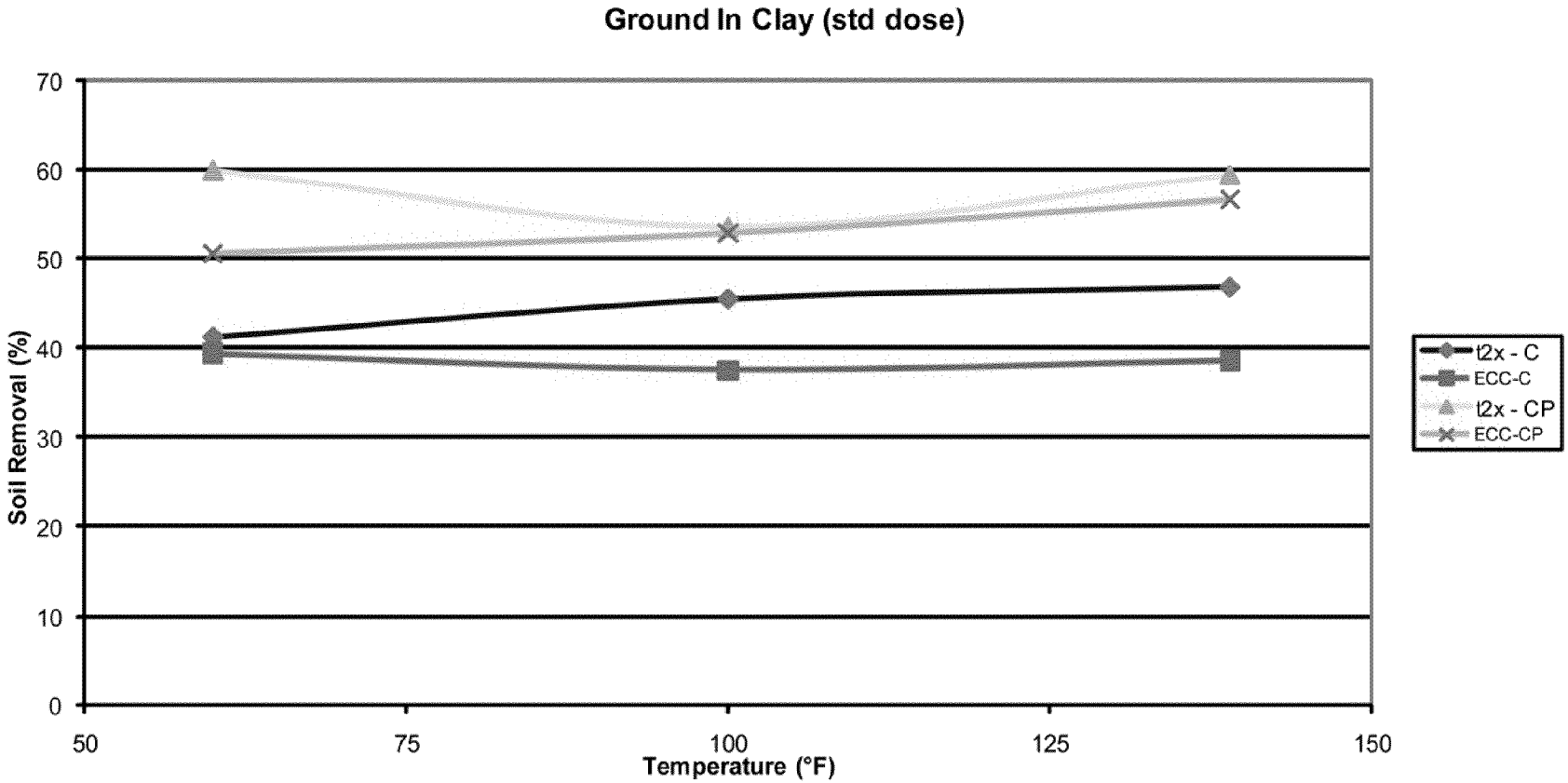
FIG. 20 is a graph depicting the comparative cleaning efficacy vs. temperature under identical conditions for the experimental cleaning composition according to one embodiment and TIDE 2X for ground in clay on both cotton and cotton-polyester textiles, using 12.5 grams of the experimental cleaning composition and 60 grams of TIDE 2X, respectively, per load.

FIG. 20 is as graph depicting the comparative cleaning efficacy vs. temperature under identical conditions for the experimental cleaning composition and TIDE 2X for ground in clay on both cotton and cotton-polyester textiles, using 12.5 grams of the experimental cleaning composition and 60 grams of TIDE 2X, respectively, per load.

Figure 21:
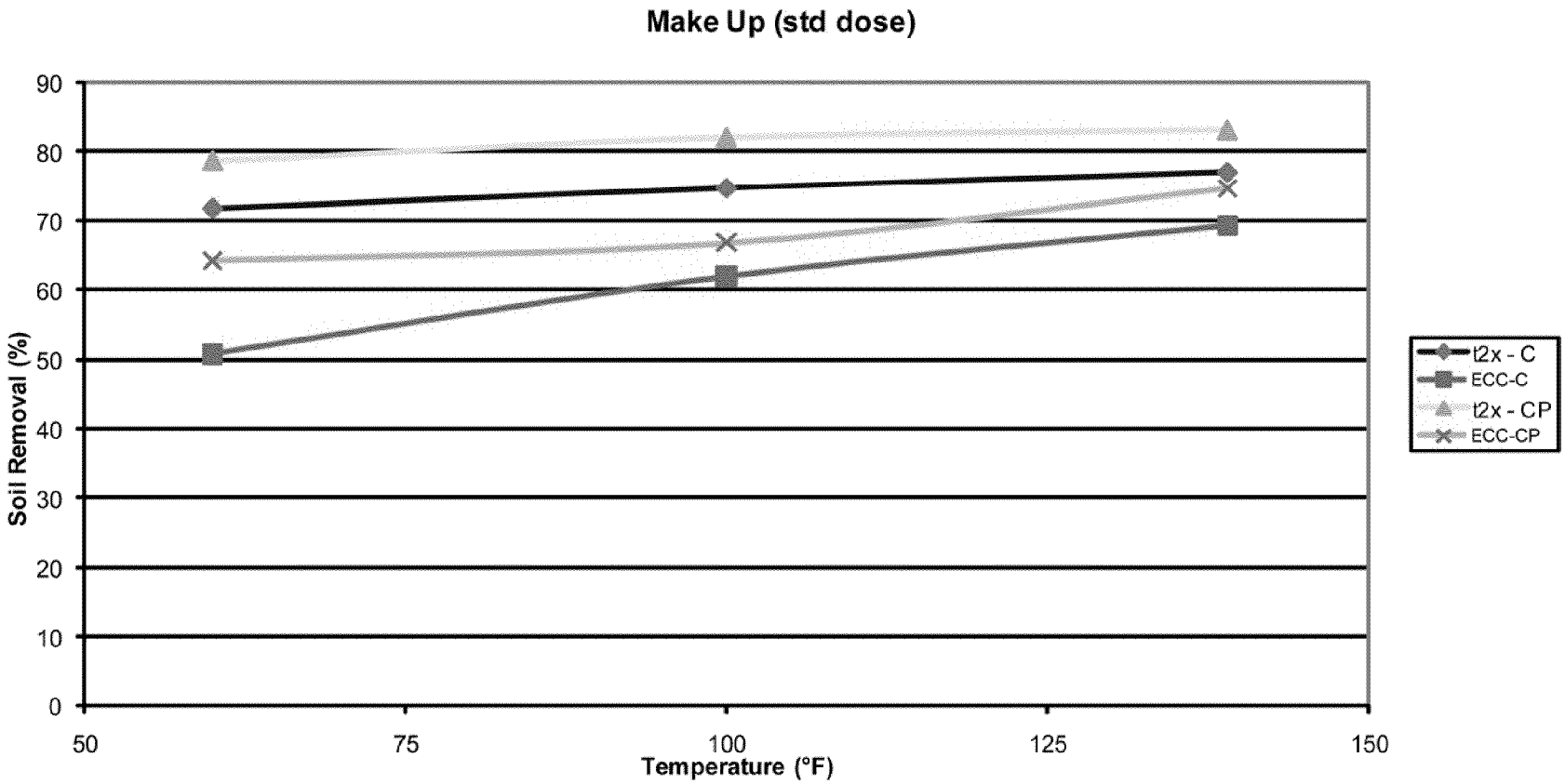
FIG. 21 is a graph depicting the comparative cleaning efficacy vs. temperature under identical conditions for the experimental cleaning composition according to one embodiment and TIDE 2X for make up on both cotton and cotton-polyester textiles, using 12.5 grams of the experimental cleaning composition and 60 grams of TIDE 2X, respectively, per load.

FIG. 21 is a graph depicting the comparative cleaning efficacy vs. temperature under identical conditions for the experimental cleaning composition and TIDE 2X for make up on both cotton and cotton-polyester textiles, using 12.5 grams of the experimental cleaning composition and 60 grams of TIDE 2X, respectively, per load.

Figure 22:
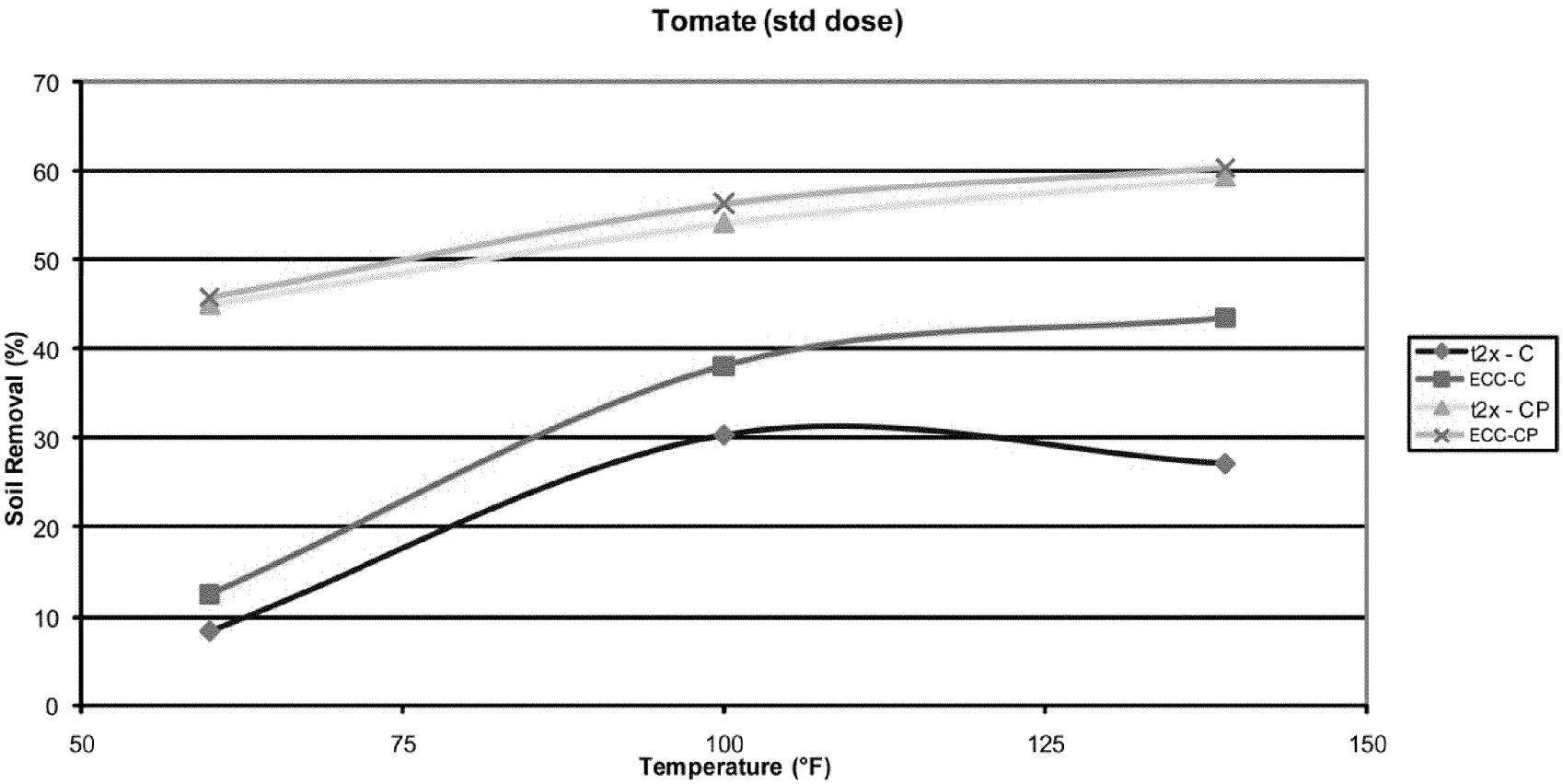
FIG. 22 is a graph depicting the comparative cleaning efficacy vs. temperature under identical conditions for the experimental cleaning composition according to one embodiment and TIDE 2X for tomato on both cotton and cotton-polyester textiles, using 12.5 grams of the experimental cleaning composition and 60 grams of TIDE 2X, respectively, per load.

FIG. 22 is a graph depicting the comparative cleaning efficacy vs. temperature under identical conditions for the experimental cleaning composition and TIDE 2X for tomato on both cotton and cotton-polyester textiles, using 12.5 grains of the experimental cleaning composition and 60 grams of TIDE 2X, respectively, per load.

As yet another comparative example, Table 6 shows the relative cleaning efficacy of a cleaning composition as set forth in Table 1 compared to another leading brand cleaning composition. It was surprisingly found that the super concentrate formulation according to one embodiment of the present invention was able to beat the performance of the leading brand with 12 mls, vs. 44.3 mls of the leading brand.

The data in Table 6 was derived according to the following parameters. The standards used were ASTM D4265-98—Standard Guide for Evaluating Stain Removal Performance in Home Laundering (modified); and ASTM E 97—Standard Method for Directional Reflectance Factor, 45-deg 0-deg, of Opaque Specimens by Broad band Filter Reflectometry.

The products tested were GreenWorks h-e natural Laundry Detergent LC#09-T0428 and a cleaning composition as set forth in Table 1. The procedure was as follows.

Artificially soiled fabrics were acquired from Test Fabrics Inc. The fabrics were selected to evaluate a good cross section of polar and non-polar soils. Unsoiled bleached cotton swatches were included in the full wash cycle to monitor anti-redeposition properties. A 50/50 used motor/olive oil mixture was prepared and applied to cotton and poly-cotton swatches for inclusion in all of the wash cycles.

The "L, a, b and y" value for each stained fabric type was determined with a Hunter colorimeter 45/0 using a UV filter, prior to cleaning.

The swatches were then laundered as follows. Three swatches for every soil were used for each detergent. The washing machine model was a top loader—Performa (model# PAVT920AWW). The washing machine settings were: regular setting, 12 minute, medium water, warm wash, (33° C.) and cold rinse. Used 8 ballast (4 cotton/4 poly-cotton) sheets from Test Fabrics Inc. Water hardness of 12.5 ppm.

"L, a, and Y" values of cleaned fabric swatches were measured using a colorimeter with a UV filter. Each of the three swatches for each stain were measured twice and then stacked on top of each other during measurement, (as per recommendations from Hunter lab outlined in bulletin, "Measuring Fabric Using the Lab Scan"). The first measurement was taken and then the swatch was turned 90° and the second measurement was taken. The 6 measurements were averaged and recorded. The L, a, b values were then used to calculate the delta E, which is a change in color of the stained fabric, according to the following equation.

$$\sqrt{(L_1-L_2)^2+(a_1-a_2)^2+(b_1-b_2)^2}$$

$L_1$—initial L value
$L_2$—final L value
$a_1$—initial a value
$a_2$—final a value
$b_1$—initial b value
$b_2$—final b value

TABLE 6

| Stain | Green Works h-e LC#09-T0428 Dosage: 44.3 mL/load | LH 12.0 IT 1.16 LC#09-T0445 Dosage: 12 mL/load |
|---|---|---|
| Grass Stain (PCS-8) (poly-cotton) | 6.39 | 7.03 |
| Grass Stain (CS-8) (cotton) | 4.18 | 4.33 |

TABLE 6-continued

| Stain | Green Works h-e LC#09-T0428 Dosage: 44.3 mL/load | LH 12.0 IT 1.16 LC#09-T0445 Dosage: 12 mL/load |
|---|---|---|
| Coffee (poly-cotton) | 0.44 | 0.49 |
| Coffee (cotton) | 1.27 | 1.67 |
| Cocoa EMPA 112 (cotton) | 10.45 | 13.88 |
| Blood/Milk/Carbon EMPA 116 (cotton) | 14.43 | 16.55 |
| Blood (cotton) | 15.45 | 18.17 |
| Red Wine EMPA 114 (cotton) | 10.02 | 9.08 |
| Tomato Beef Sauce (cotton) | 10.00 | 10.45 |
| Dust sebum (cotton) | 6.14 | 6.35 |
| Oil Stain (cotton) | 36.85 | 37.52 |
| Oil Stain (poly-cotton) | 13.26 | 14.50 |
| Delta E total: | 128.9 | 140.0 |

There has thus been described several embodiments or a cleaning composition and potential packaging, which surprisingly provide unexpected and unobvious results, such as a generally flat cleaning efficacy profile across a range of dosages, as well as a low viscosity that enables single-handed pumping of the cleaning composition. Moreover, the ability to package the composition in a handheld pump that provides a large number of laundry loads per package meets a long felt and unresolved market need for such a product.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A cleaning composition, comprising:

a surfactant system comprising:

a nonionic surfactant present in an amount from 15 to 60 wt % based on a total weight of the cleaning composition, the nonionic surfactant including an ethoxylated alcohol and/or an ethoxylated fatty acid ester, and an anionic surfactant present in an amount from 15 to 55 wt % based on the total weight of the cleaning composition;

free water present in an amount from greater than 0 to less than or equal to 10 wt % based on the total weight of the cleaning composition;

a solvent system comprising a polyalcohol, the solvent system being present in an amount effective to solubilize the surfactant system in the water; and an enzyme present in an amount from greater than 0 to less than or equal to 15 wt % based on the total weight of the cleaning composition, wherein the cleaning composition is in a form of an invert emulsion, wherein the cleaning composition present in an amount from about 9 to about 22 grams is characterized as exhibiting about a constant cleaning efficacy when added to 69 liters of exterior water, wherein the constant cleaning efficacy corresponds to a % stain removal that varies by less than about 10%.

2. The cleaning composition of claim 1, wherein the free water is present in an amount from greater than 0 to less than or equal to 5 wt % based on the total weight of the cleaning composition, wherein a weight ratio of the nonionic surfactant to the anionic surfactant is from about 1.25:1 to about 3.50:1.

3. The cleaning composition of claim 1, wherein a weight ratio of the nonionic surfactant to the anionic surfactant is from about 1.40:1 to about 3.25:1.

4. The cleaning composition of claim 1, wherein the free water is present in an amount from greater than 0 to less than or equal to 2 wt % based on the total weight of the cleaning composition.

5. The cleaning composition of claim 1, wherein the % stain removal is measured using test procedure ASTM D4265.

6. The cleaning composition of claim 1, wherein the nonionic surfactant includes the ethoxylated alcohol, wherein the ethoxylated alcohol has the formula: $R^1(OC_2H_4)_nOH$, wherein $R^1$ is a hydrocarbon group, and n is from 2 to 12.

7. The cleaning composition of claim 6, wherein n is from 3 to 9.

8. The cleaning composition of claim 6, wherein $R^1$ is an aliphatic group having 6 to 22 carbon atoms.

9. The cleaning composition of claim 6, wherein $R^1$ is an alkyl group having 8 to 20 carbon atoms.

10. The cleaning composition of claim 1, further comprising an antiredeposition agent selected from a group consisting of: poly-4-vinylpyridine-N-oxide (PVnO); polyvinyl acetate; and combinations thereof.

11. The cleaning composition of claim 10, further comprising a non-phosphate builder in an amount from greater than 0 to less than or equal to 15 wt % based on the total weight of the cleaning composition, wherein the non-phosphate builder includes at least one of: ethylenediaminetetraacetic acid (EDTA); nitriloacetic acid; sodium polyaspartate; and combinations thereof.

12. The cleaning composition of claim 1, wherein the nonionic surfactant includes the ethoxylated alcohol and the ethoxylated fatty acid ester, wherein the ethoxylated alcohol is present in an amount from 13 wt % to 38 wt % based on the total weight of the cleaning composition, and wherein the ethoxylated fatty acid ester is present in an amount from greater than 0 wt % to less than or equal to 20 wt % based on the total weight of the cleaning composition.

13. The cleaning composition of claim 1, wherein the anionic surfactant is a sulfonate salt and/or a sulfate salt, each of which independently contains an organic radical having 6 to 22 carbon atoms.

14. The cleaning composition of claim 13, wherein the organic radical is selected from the group consisting of a fatty acid group or a salt thereof, an ester of a fatty acid group, an alkyl group, an alkenyl group, an alkyl ether group, an alkenyl ether group, and a mixture thereof.

15. The cleaning composition of claim 13, wherein the sulfonate salt and/or the sulfate salt is independently an alkali metal salt or an ammonium salt.

16. The cleaning composition of claim 1, wherein the anionic surfactant includes a sulfonate of a secondary alkane and a sodium sulfonate mixture of a fatty acid, wherein the sulfonate of a secondary alkane is present in an amount from greater than 0 wt % to less than or equal to 20 wt % based on the total weight of the cleaning composition, and wherein the sodium sulfonate mixture of a fatty acid is present in an amount from 10 wt % to 30 wt % based on the total weight of the cleaning composition.

17. The cleaning composition of claim 1, wherein the anionic surfactant is present in an amount from about 10 to about 35 wt % based on the total weight of the cleaning composition.

18. The cleaning composition of claim 1, wherein the anionic surfactant is present in an amount from about 13 to about 20 wt % based on the total weight of the cleaning composition.

19. The cleaning composition of claim 1, wherein the solvent system further comprises a methyl ether of a polyalcohol.

20. The cleaning composition of claim 19, wherein a weight ratio of the polyalcohol to the methyl ether of a polyalcohol is between about 1.0 and about 8.7.

21. The cleaning composition of claim 20, wherein the weight ratio of the polyalcohol and the methyl ether of a polyalcohol is from about 1.4 to about 3.5.

22. The cleaning composition of claim 19, wherein the solvent system further comprises an ingredient selected from the group consisting of a methyl ester of a fatty acid, an alcohol, water, and a mixture thereof.

23. The cleaning composition of claim 1, wherein the polyalcohol is present in an amount from 3 to 26 wt % based on the total weight of the cleaning composition, and wherein the solvent system further comprises a methyl ether of a polyalcohol present in an amount from greater than 0 to less than or equal to 10 wt % based on the total weight of the cleaning composition, a methyl ester of a fatty acid present in an amount from greater than 0 to less than or equal to 26 wt % based on the total weight of the cleaning composition, and an alcohol present in an amount from greater than 0 to 8 wt % based on the total weight of the cleaning composition.

24. The cleaning composition of claim 1, wherein the solvent system is present in an amount from about 1.5 to about 55 wt % based on the total weight of the cleaning composition.

25. The cleaning composition of claim 1, wherein the solvent system is present in an amount from about 5 to about 30 wt % based on the total weight of the cleaning composition.

26. The cleaning composition of claim 1, wherein the solvent system is present in an amount from about 9 to about 22 wt % based on the total weight of the cleaning composition.

27. The cleaning composition of claim 1, wherein the enzyme includes a digestive enzyme, wherein the digestive enzyme is selected from the group consisting of a protease enzyme, an amylase enzyme, a cellulase enzyme, a lipase enzyme, a manninase enzyme, and combinations thereof.

28. The cleaning composition of claim 1, wherein the enzyme includes a digestive enzyme, wherein the digestive enzyme is present in an amount of less than about 12 wt % based on the total weight of the cleaning composition.

29. The cleaning composition of claim 1, wherein the enzyme includes a digestive enzyme, wherein the digestive enzyme is present in an amount from about 4 to about 8 wt % based on the total weight of the cleaning composition.

30. The cleaning composition of claim 1, wherein a viscosity of the cleaning composition is about 200 centipoise or less at 23° C.

31. The cleaning composition of claim 1, further comprising at least two of an enzyme stabilizer, a fragrant agent, a non-phosphate builder, an antiredeposition agent, a booster, a preservative, and a combination thereof.

32. The cleaning composition of claim 1, which comprises at least a 5X concentrate.

33. The cleaning composition of claim 1, wherein the cleaning composition is encapsulated in a water-soluble capsule.

34. A method for cleaning a non-textile surface, comprising:

applying the cleaning composition of claim 1 to a non-textile surface; and washing the non-textile surface with water to clean the non-textile surface.

35. A method for cleaning a non-textile surface, comprising:

directly applying a first amount of the cleaning composition of claim 1 to a nontextile surface;

dissolving a second amount of the cleaning composition in a volume of water to form a diluted, aqueous cleaning composition; and applying the diluted aqueous cleaning composition to the non-textile surface to clean the surface.

36. A cleaning composition, comprising:

a surfactant system comprising:

an anionic surfactant present in an amount from 15 to 60 wt % based on a total weight of the cleaning composition, the anionic surfactant including a sulfonate of a secondary alkane and a sodium sulfonate mixture of a fatty acid, and a nonionic surfactant present in an amount from 15 to 55 wt % based on the total weight of the cleaning composition, the nonionic surfactant including one or more fatty alcohol ethoxylates and one or more ethoxylated fatty acid methyl esters;

a solvent system comprising a humectant, the solvent system being present in an amount ranging from 1.5 to 55 wt % based on a total weight of the cleaning composition; and total water present in an amount from greater than 0 o less than or equal to 35 wt % based on the total weight of the cleaning composition, wherein the cleaning composition is in a form of an invert emulsion, wherein a weight ratio of the nonionic surfactant to the anionic surfactant is from about 1:1 to about 4:1, and wherein the cleaning composition present in an amount from about 9 to about 22 grams is characterized as having a property exhibiting about a constant cleaning efficacy when the cleaning composition is added to 69 liters of exterior water, wherein the constant cleaning efficacy corresponds to a % stain removal that varies by less than about 10%.

37. The cleaning composition of claim 36, wherein the anionic surfactant is present in an amount from 25 to 60 wt % based on a total weight of the cleaning composition.

38. The cleaning composition of claim 36, further comprising an enzyme present in an amount from greater than 0 to less than or equal to 15 wt % based on the total weight of the cleaning composition.

39. The cleaning composition of claim 1, wherein the surfactant system comprises invert micelles.

40. The cleaning composition of claim 1, wherein the nonionic surfactant is present in an amount from 25 to 60 wt % based on a total weight of the cleaning composition.

41. The cleaning composition of claim 36, wherein the surfactant system comprises invert micelles.

42. The cleaning composition of claim 36, wherein the total water includes free water present in an amount from greater than 0 to less than or equal to 2 wt %.

43. The cleaning composition of claim 36, wherein the % stain removal is measured using test procedure ASTM D4265.

44. The cleaning composition of claim 36, wherein the sulfonate of a secondary alkane is present in an amount from greater than 0 wt % to less than or equal to 20 wt % based on the total weight of the cleaning composition, and wherein the sodium sulfonate mixture of a fatty acid is present in an amount from 10 wt % to 30 wt % based on the total weight of the cleaning composition.

45. the cleaning composition of claim 44, wherein the fatty alcohol ethoxylates are present in an amount from 13 wt % to 38 wt % based on the total weight of the cleaning composition, and wherein the ethoxylated fatty acid methyl ester is present in an amount from greater than 0 wt % to less than or equal to 20 wt % based on the total weight of the cleaning composition.

46. The cleaning composition of claim 36, wherein the solvent system further comprises glycerin in an amount from about 3 wt % to about 11 wt % based on the total weight of the cleaning composition.

* * * * *